US012510270B2

(12) United States Patent
Kim et al.

(10) Patent No.: US 12,510,270 B2
(45) Date of Patent: Dec. 30, 2025

(54) WINDOW TYPE AIR-CONDITIONER AND INSTALLATION METHOD THEREOF

(71) Applicant: SAMSUNG ELECTRONICS CO., LTD, Suwon-si (KR)

(72) Inventors: Munsub Kim, Suwon-si (KR); Duhan Jung, Suwon-si (KR); Jaewoo Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 216 days.

(21) Appl. No.: 18/208,055

(22) Filed: Jun. 9, 2023

(65) Prior Publication Data

US 2024/0085056 A1 Mar. 14, 2024

Related U.S. Application Data

(63) Continuation of application No. PCT/KR2023/007650, filed on Jun. 2, 2023.

(30) Foreign Application Priority Data

Sep. 14, 2022 (KR) ..... 10-2022-0115808

(51) Int. Cl.
*F24F 13/32* (2006.01)
*F24F 1/0057* (2019.01)
(Continued)

(52) U.S. Cl.
CPC ..... *F24F 13/32* (2013.01); *F24F 1/0057* (2019.02); *F24F 1/32* (2013.01); *F24F 1/62* (2013.01); *F24F 2221/20* (2013.01)

(58) Field of Classification Search
CPC .... F24F 1/0057; F24F 1/32; F24F 1/62; F24F 2221/20; F24F 1/0003; F24F 1/027; F24F 13/24; F24F 13/22
See application file for complete search history.

(56) References Cited

U.S. PATENT DOCUMENTS 2,708,833 A * 5/1955 Nigro ..... F24F 1/04 62/297
3,176,474 A * 4/1965 Abbott ..... F24F 1/0003 62/262
(Continued)

FOREIGN PATENT DOCUMENTS

CN 111853960 10/2020
JP 3147223 U 12/2008
(Continued)

OTHER PUBLICATIONS

International Search Report dated Aug. 30, 2023 for International Application No. PCT/KR2023/007650.
(Continued)

*Primary Examiner* — Lionel Nouketcha
(74) *Attorney, Agent, or Firm* — STAAS & HALSEY LLP

(57) ABSTRACT

A window type air conditioner including an outdoor module including a compressor, an outdoor heat exchanger, and an outdoor housing; an indoor module including an indoor heat exchanger, and an indoor housing spaced apart from the outdoor housing; a refrigerant pipe through which refrigerant moves between the indoor and the outdoor module; and a connection support module including a first connection rod having an inner circumferential surface, and a sealing member inside the first connection rod, wherein the connection support module connects, and supports a positional relationship between, the indoor and the outdoor module, the refrigerant pipe extends through the first connection rod so that an inner circumferential surface of the first connection rod is spaced apart from an outer circumferential surface of the refrigerant pipe, and the sealing member is arranged to form a seal between the refrigerant pipe and the first connection rod.

12 Claims, 36 Drawing Sheets

(51) Int. Cl.
*F24F 1/32* (2011.01)
*F24F 1/62* (2011.01)

(56) References Cited

U.S. PATENT DOCUMENTS

| | | | | |
|---|---|---|---|---|
| 3,296,820 | A * | 1/1967 | Bauman | F24F 1/0057 62/262 |
| 5,167,131 | A * | 12/1992 | Karkhanis | F24F 1/027 62/262 |
| 5,582,025 | A | 12/1996 | Dubin et al. | |
| 6,336,338 | B1 * | 1/2002 | Koren | F24F 1/027 62/262 |
| 6,568,201 | B1 * | 5/2003 | Cur | F24F 1/027 62/262 |
| 7,430,874 | B2 * | 10/2008 | Prince | B60H 1/323 62/244 |
| 7,992,404 | B2 * | 8/2011 | Su | F24F 1/027 62/262 |
| 10,739,018 | B2 | 8/2020 | Baumann et al. | |
| 11,384,945 | B2 * | 7/2022 | Aryeh | F24F 13/20 |
| 11,480,346 | B2 | 10/2022 | Rao et al. | |
| 2007/0125111 | A1 | 6/2007 | Xiao | |
| 2020/0124296 | A1 * | 4/2020 | Baumann | F24F 1/027 |
| 2020/0217521 | A1 | 7/2020 | Lundstrom | |
| 2021/0190330 | A1 | 6/2021 | Martinez Galvan | |
| 2021/0332988 | A1 | 10/2021 | Xing et al. | |
| 2021/0355750 | A1 | 11/2021 | Liang et al. | |
| 2021/0381700 | A1 | 12/2021 | Aryeh | |
| 2022/0146121 | A1 | 5/2022 | Si et al. | |

FOREIGN PATENT DOCUMENTS

| | | | |
|---|---|---|---|
| KR | 20-2008-0004797 | U | 10/2008 |
| KR | 10-1132617 | B1 | 4/2012 |
| KR | 106765654 | B | 6/2020 |
| KR | 10-2021-0120604 | A | 10/2021 |
| KR | 10-2311991 | B1 | 10/2021 |
| KR | 10-2320991 | B1 | 11/2021 |

OTHER PUBLICATIONS

Partial Supplementary European Search Report dated Aug. 4, 2025 for European Application No. 23865652.4.
Extended European Search Report dated Oct. 27, 2025 for EP Patent Application No. 23865652.4.

* cited by examiner

WINDOW TYPE AIR-CONDITIONER AND INSTALLATION METHOD THEREOF

CROSS-REFERENCE TO RELATED APPLICATION

This application is a continuation application, under 35 U.S.C. § 111 (a), of international application No. PCT/KR2023/007650, filed on Jun. 2, 2023, which claims priority under 35 U.S.C. § 119 to Korean Patent Application No. 10-2022-0115808, filed on Sep. 14, 2022, the disclosures of which are incorporated herein by reference in their entirety.

TECHNICAL FIELD

Embodiments provide a window type air conditioner and an installation method of the window type air conditioner.

BACKGROUND ART

An air conditioner may include a compressor compressing a refrigerant, a heat exchanger (a condenser or an evaporator) inducing heat exchange with the refrigerant, an expansion valve, and a blower for promoting heat exchange with the refrigerant.

Air conditioners may be divided into separate type air conditioners in which indoor and outdoor units are separated from each other, and window type air conditioners installable on a window frame in a state in which indoor and outdoor units are integrally formed.

Because the window type air conditioner is installable on a window frame, its installation is easy. However, due to the installation of the window type air conditioner, a gap may occur between the window and the window frame, and thus, external noise, for example, noise of a compressor may enter the room. This may cause discomfort to a user of the window type air conditioner.

DESCRIPTION OF EMBODIMENTS

Solution to Problem

According to an embodiment of the disclosure, a window type air conditioner, installable on a window frame, includes an outdoor module including a compressor configured to compress a refrigerant, an outdoor heat exchanger configured to perform heat exchange between outdoor air and the refrigerant, and an outdoor housing configured to accommodate the compressor and the outdoor heat exchanger; an indoor module including an indoor heat exchanger configured to perform heat exchange between indoor air and the refrigerant, and an indoor housing spaced apart from the outdoor housing and configured to accommodate the indoor heat exchanger; a refrigerant pipe through which the refrigerant moves between the indoor module and the outdoor module; and a connection support module including a first connection rod having an inner circumferential surface, and a sealing member arranged inside the first connection rod. The connection support module may be configured so that the connection support module connects the indoor module and the outdoor module, and supports a positional relationship between the indoor module and the outdoor module, the refrigerant pipe extends through the first connection rod so that an inner circumferential surface of the first connection rod is spaced apart from an outer circumferential surface of the refrigerant pipe, and the sealing member is arranged between the outer circumferential surface of the refrigerant pipe and the inner circumferential surface of the first connection rod to form a seal between the refrigerant pipe and the first connection rod.

According to an embodiment of the disclosure, a width of the first connection rod is up to 5 times greater than a diameter of the refrigerant pipe.

According to an embodiment of the disclosure, a height of the first connection rod is up to 5 times greater than a width of the first connection rod.

According to an embodiment of the disclosure, the refrigerant pipe includes a first refrigerant pipe configured to connect between the compressor and the indoor heat exchanger, and a second refrigerant pipe configured to connect between the outdoor heat exchanger and the indoor heat exchanger, and the first connection rod includes a first refrigerant connection frame configured to surround the first refrigerant pipe, and a second refrigerant connection frame configured to surround the second refrigerant pipe.

According to an embodiment of the disclosure, the first refrigerant connection frame and the second refrigerant connection frame are spaced apart from each other in a vertical direction.

According to an embodiment of the disclosure, the connection support module includes a reinforcing plate arranged between the first refrigerant connection frame and the second refrigerant connection frame.

According to an embodiment of the disclosure, the first refrigerant connection frame and the second refrigerant connection frame are configured to contact each other in a vertical direction.

According to an embodiment of the disclosure, the window type air conditioner further includes a wire configured to form electrical connection between the indoor module and the outdoor module, wherein the connection support module further includes a second connection rod configured to accommodate the wire therein and having a structure surrounding the wire.

According to an embodiment of the disclosure, the window type air conditioner further includes a temporary support portion detachably connected between the indoor module and the outdoor module, the temporary support configured to support the positional relationship between the indoor module and the outdoor module, and be removed before the window type air conditioner is installed on the window frame.

According to an embodiment of the disclosure, the indoor housing and the outdoor housing respectively include first fastening holes configured to receive a fastening member, the temporary support portion includes a plurality of second fastening holes corresponding to the first fastening holes of each of the indoor housing and the outdoor housing, when the fastening member is received into the first fastening holes and the plurality of the second fastening holes, the temporary support portion is fixed to the indoor housing and the outdoor housing, and when the fastening member is separated from the first fastening holes and the plurality of the second fastening holes, the temporary support portion is detached from the indoor housing and the outdoor housing.

According to an embodiment of the disclosure, the temporary support portion includes a pair of support plates detachably connected to the indoor module and the outdoor module respectively on opposite sides.

According to an embodiment of the disclosure, the window type air conditioner further includes a gap blocking member including openings configured to accommodate the connection support module, and configured to form a seal between a window and the window frame.

According to an embodiment of the disclosure, the window type air conditioner further includes a drain hose configured to transfer condensed water generated by the indoor heat exchanger to the outdoor module, wherein a height of at least a part of the drain hose is lowered from the indoor module to the outdoor module so that the condensed water moves toward the outdoor module due to gravity.

According to an embodiment of the disclosure, a method of installing a window type air conditioner on a window frame includes preparing the window type air conditioner including an indoor module, an outdoor module separated from the indoor module, a connection support module configured to connect, and to support a positional relationship between, the indoor module and the outdoor module, and a temporary support portion configured to connect the indoor module to the outdoor module and detachably connected to the indoor module and the outdoor module; installing a gap blocking member including an opening on the window frame; arranging the window type air conditioner on the window frame so that the connection support module is inserted into the opening of the gap blocking member; fixing the indoor module and the outdoor module of the window type air conditioner to the window frame using brackets; and separating the temporary support portion from the indoor module and the outdoor module.

According to an embodiment of the disclosure, the temporary support portion includes a pair of support plates detachably connected to the indoor module and the outdoor module respectively on opposite sides, and the method further includes before moving the window type air conditioner so that the connection support module of the window type air conditioner is inserted into the opening of the gap blocking member, separating one of the pair of support plates from the indoor module and the outdoor module, wherein the separating of the temporary support portion includes separating a remaining one of the pair of support plates from the indoor module and the outdoor module.

MODE OF DISCLOSURE

Figure 1:
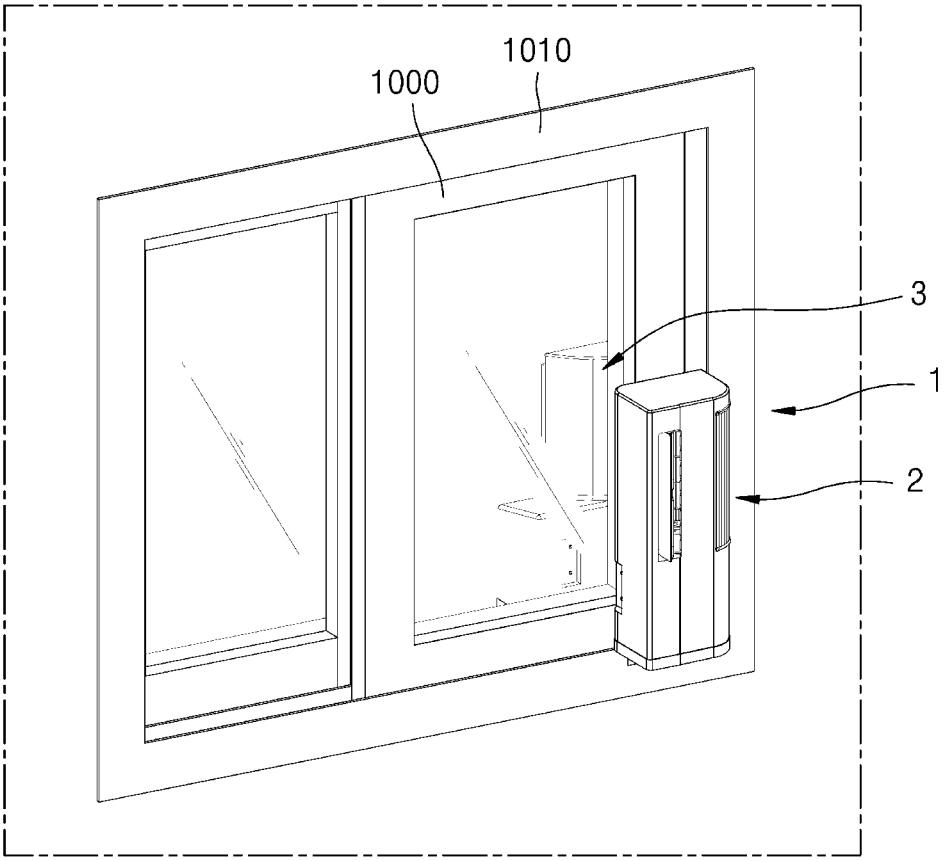
FIG. 1 is a perspective view illustrating a window type air conditioner installed on a window frame according to an embodiment of the disclosure.

Throughout the disclosure, the expression "at least one of a, b or c" indicates only a, only b, only c, both a and b, both a and c, both b and c, all of a, b, and c, or variations thereof.

Embodiments of the disclosure will be described more fully with reference to the accompanying drawings. In the drawings, like reference numerals or symbols refer to like components or elements performing substantially the same functions.

It will be understood that, although the terms including an ordinal number such as "first", "second", etc., may be used herein to describe various elements or components, these elements or components should not be limited by the terms. The terms are only used to distinguish one element or component from another element or component. For example, as used herein, a first element or component may be termed a second element or component without departing from the scope of the disclosure, and similarly, a second element or component may be termed a first element or component. As used herein, the term "and/or" includes any and all combinations of one or more of the associated listed items.

The terms used herein are for the purpose of describing an embodiment of the disclosure and is not intended to limit the disclosure. As used herein, singular forms are intended to include the plural forms as well, unless the context clearly indicates otherwise. It will be further understood that the terms "comprises" and/or "includes" when used in this specification, specify the presence of stated features, numbers, steps, operations, elements, components, or combinations thereof, but do not preclude the presence or addition of one or more other features, numbers, steps, operations, elements, components, or combinations thereof. In the drawings, like reference numerals represent like elements performing substantially the same functions.

Figure 2:
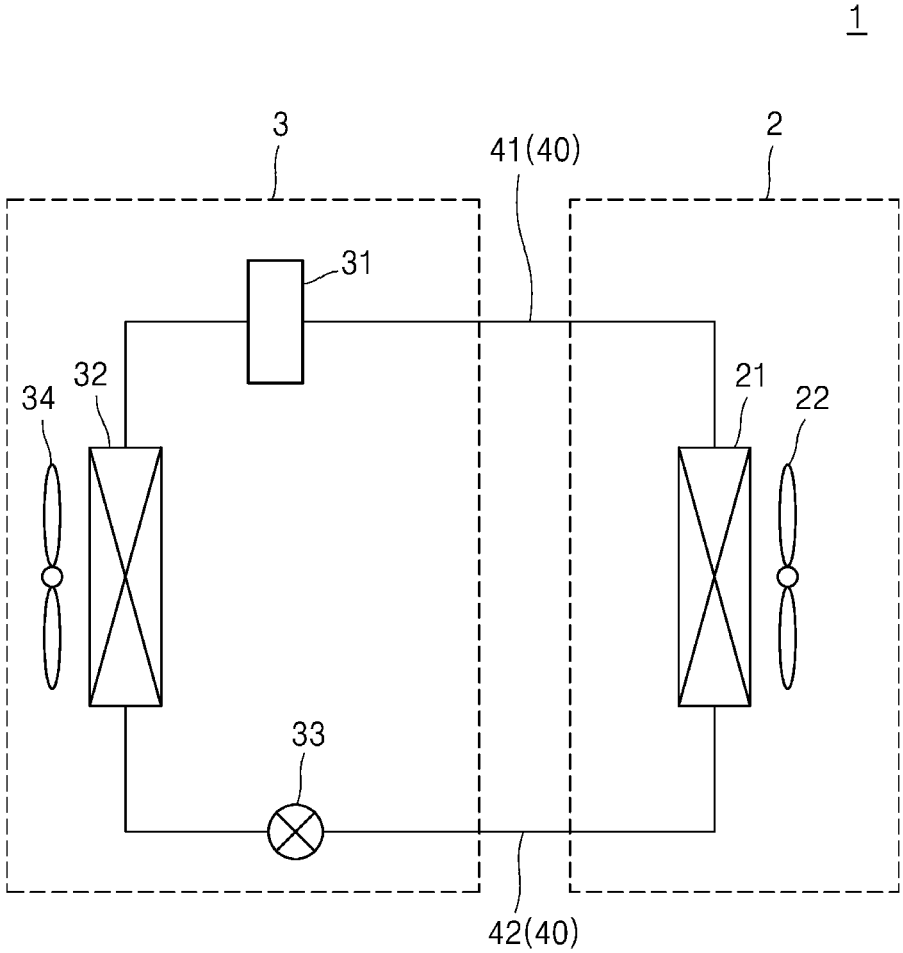
FIG. 2 is a diagram conceptually illustrating the configuration of a window type air conditioner according to an embodiment of the disclosure.
Figure 3:
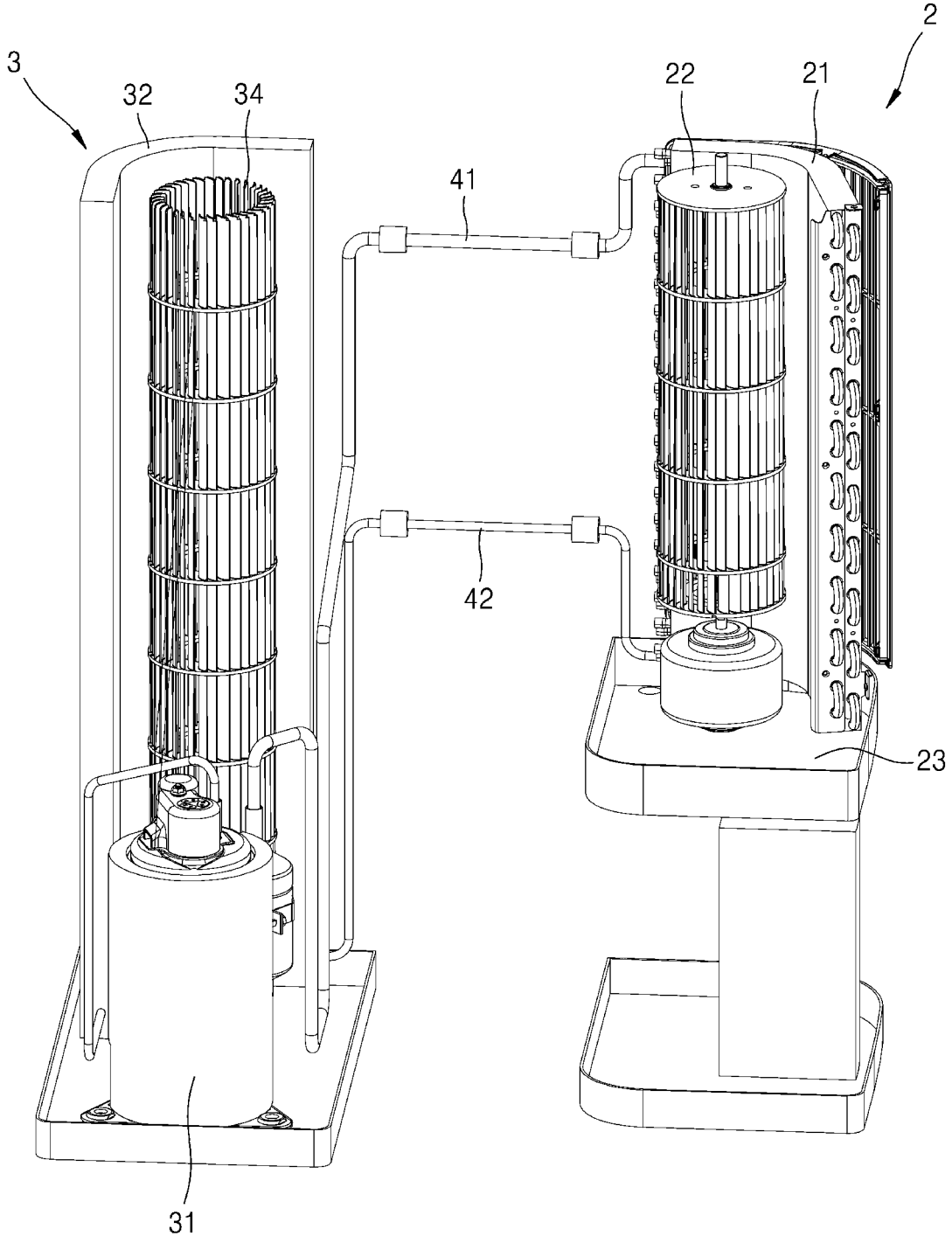
FIG. 3 is a perspective view illustrating the configuration of a window type air conditioner according to an embodiment of the disclosure.

FIG. 1 is a perspective view illustrating a window type air conditioner 1 installed on a window frame 1010 according to an embodiment of the disclosure. FIG. 2 is a diagram conceptually illustrating the configuration of the window type air conditioner 1 according to an embodiment of the disclosure. FIG. 3 is a perspective view illustrating the configuration of the window type air conditioner 1 according to an embodiment of the disclosure.

Referring to FIG. 1, the window type air conditioner 1 according to an embodiment of the disclosure is a device installable on the window frame 1010 and may perform a function of providing cooling to a room. The window frame 1010 on which the window type air conditioner 1 is installed may be a frame that supports a window 1000 to be slidably movable.

Referring to FIG. 2, the window type air conditioner 1 according to an embodiment of the disclosure may include a compressor 31, an outdoor heat exchanger 32, an expansion device 33, and an indoor heat exchanger 21.

The compressor 31 may compress a refrigerant. The compressor 31 may compress a gaseous refrigerant. The gaseous refrigerant may be converted from a low-temperature low-pressure state to a high-temperature high-pressure state while being compressed by the compressor 31.

The outdoor heat exchanger 32 may perform heat exchange between the refrigerant and outdoor air. The outdoor heat exchanger 32 and the compressor 31 are connected to each other so that the refrigerant may be movable. The outdoor heat exchanger 32 condenses the high-temperature and high-pressure refrigerant transferred from the compressor 31 during which the refrigerant may release heat to outdoor air.

An outdoor fan 34 may be provided near the outdoor heat exchanger 32. The outdoor fan 34 may blow outdoor air to the outdoor heat exchanger 32 to promote heat exchange between the refrigerant and the outdoor air.

The expansion device 33 may reduce the pressure and temperature of the refrigerant condensed by the outdoor heat exchanger 32. The expansion device 33 and the outdoor heat exchanger 32 are connected to each other so that the refrigerant may be movable. For example, the expansion device 33 may reduce the pressure and temperature of the refrigerant by using the throttling effect. For example, the expansion device 33 may reduce the pressure and temperature of the refrigerant by using an orifice.

In the indoor heat exchanger 21, heat exchange between the refrigerant and indoor air may occur. The indoor heat exchanger 21 and the expansion device 33 are connected to each other so that the refrigerant may be movable. In the indoor heat exchanger 21, low-temperature and low-pressure refrigerant may evaporate. The refrigerant may absorb heat from the room air while evaporating.

An indoor fan 22 may be provided near the indoor heat exchanger 21. The indoor fan 22 may blow indoor air to the indoor heat exchanger 21 to promote heat exchange between the refrigerant and the indoor air.

A drain pan 23 may be provided below the indoor heat exchanger 21. Thus, while the indoor heat exchanger 21 is operating, condensed water generated on the surface of the indoor heat exchanger 21 may be stored in the drain pan 23.

The refrigerant passing through the indoor heat exchanger 21 may be in a low-temperature and low-pressure state. This low-temperature and low-pressure refrigerant may be transferred to the compressor 31. Accordingly, the above process may be repeated.

As described above, while the window type air conditioner 1 is operating, the refrigerant moves along a refrigerant pipe 40, the indoor air is cooled while the refrigerant is evaporating in the indoor heat exchanger 21, and heat is released while the outdoor heat exchanger 32 is condensing the refrigerant. The refrigerant pipe 40 may include a first refrigerant pipe 41 connecting between the compressor 31 and the indoor heat exchanger 21 and a second refrigerant pipe 42 connecting between the outdoor heat exchanger 32 and the indoor heat exchanger 21.

However, while the window type air conditioner 1 is operating, noise may be generated in some configurations, and when such noise is transferred to a user, the noise may cause discomfort of the user. For example, while the window type air conditioner 1 is operating, loud noise may be generated while the compressor 31 is compressing the refrigerant to a high pressure. When the noise generated by the compressor 31 is transferred to the user, discomfort may be caused to the user.

The window type air conditioner 1 according to an embodiment of the disclosure may have a structure in which an outdoor module 3 including the compressor 31 is separated from an indoor module 2 in order to prevent noise generated from the compressor 31 from entering the room.

Figure 4:
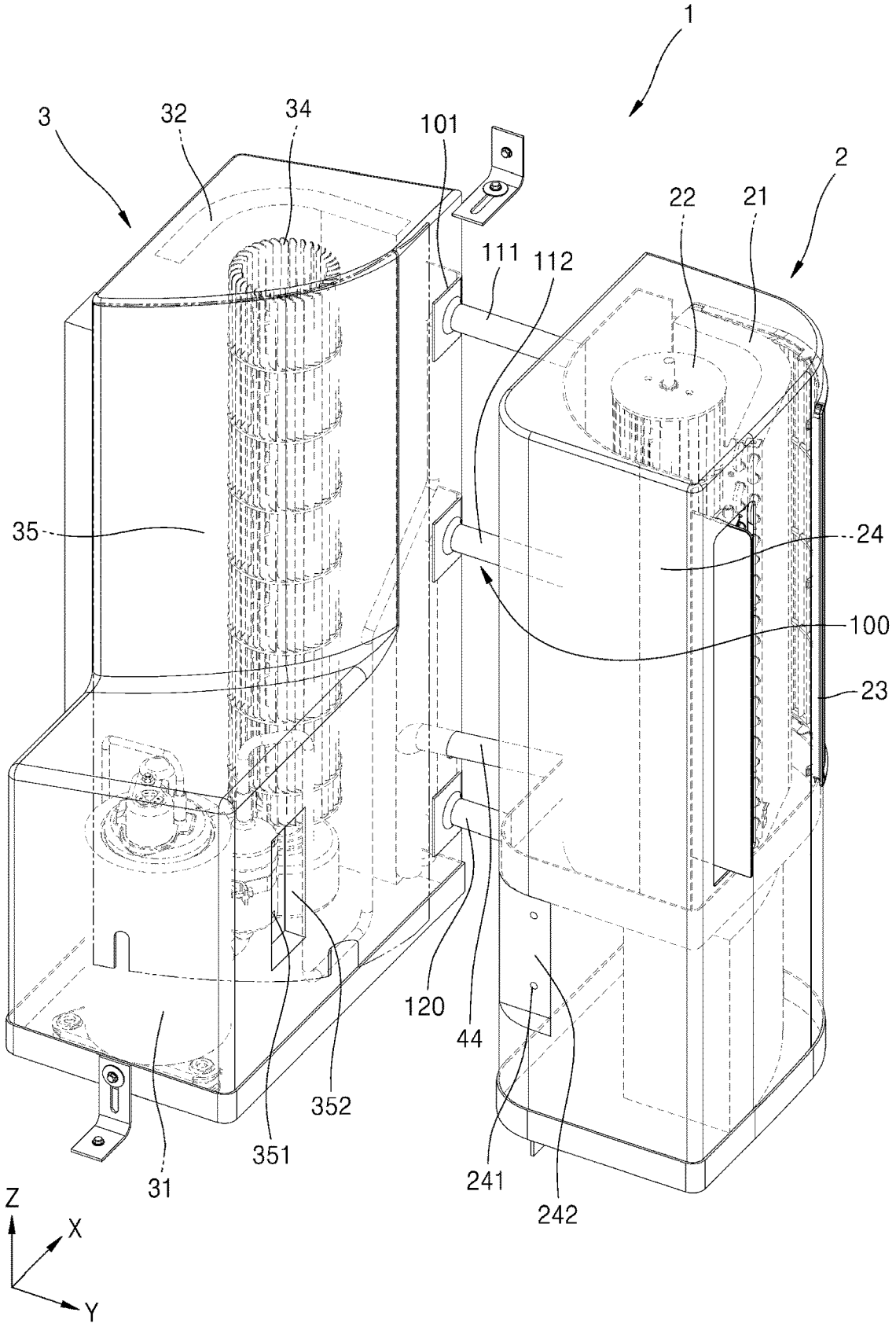
FIG. 4 is a perspective view illustrating a window type air conditioner according to an embodiment of the disclosure.

FIG. 4 is a perspective view illustrating the window type air conditioner 1 according to an embodiment of the disclosure.

Referring to FIG. 4, the window type air conditioner 1 according to an embodiment of the disclosure may include the indoor module 2, the outdoor module 3 separated from the indoor module 2, and a connection support module 100 connecting between the indoor module 2 and the outdoor module 3.

The outdoor module 3 may include the compressor 31, the outdoor heat exchanger 32, and an outdoor housing 35 accommodating the compressor 31 and the outdoor heat exchanger 32. The outdoor module 3 may further include the outdoor fan 34 disposed inside the outdoor housing 35. Although the expansion device 33 is not shown in FIG. 4, the expansion device 33 may be arranged in either the outdoor module 3 or the indoor module 2. The shape of the outdoor housing 35 may vary. For example, an upper surface of the outdoor housing 35 may be inclined so that rainwater easily flows down.

The indoor module 2 may include an indoor housing 24 spaced apart from the outdoor housing 35 and the indoor heat exchanger 21 disposed inside the indoor housing 24. The indoor module 2 further includes the indoor fan 22 disposed inside the indoor housing 24.

The connection support module 100 supports the indoor module 2 and the outdoor module 3. The connection support module 100 may connect between the indoor housing 24 and the outdoor housing 35. One end of the connection support module 100 may be fixed to the indoor housing 24 and the other end may be fixed to the outdoor housing 35. Flanges 101 fixing the connection support module 100 to the indoor housing 24 and the outdoor housing 35 may be provided on both ends of the connection support module 100.

The connection support module 100 may include a material having a certain strength. For example, the connection support module 100 may include steel. For example, the connection support module 100 may include galvanized steel. However, the material of the connection support module 100 is not limited thereto, and may be various as long as the material is a steel material having a certain strength. As the connection support module 100 has a certain strength, the position relationship between the indoor module 2 and the outdoor module 3 may be fixed by the connection support module 100.

Meanwhile, a drain hose 44 may be disposed between the indoor module 2 and the outdoor module 3. The drain hose 44 may transfer the condensed water generated in the indoor heat exchanger 21 to the outdoor module 3. One end of the drain hose 44 may be connected to the drain pan 23. The height of at least a part of the drain hose 44 may be lowered from the indoor module 2 to the outdoor module 3 so as to facilitate the movement of condensed water.

Figure 5:
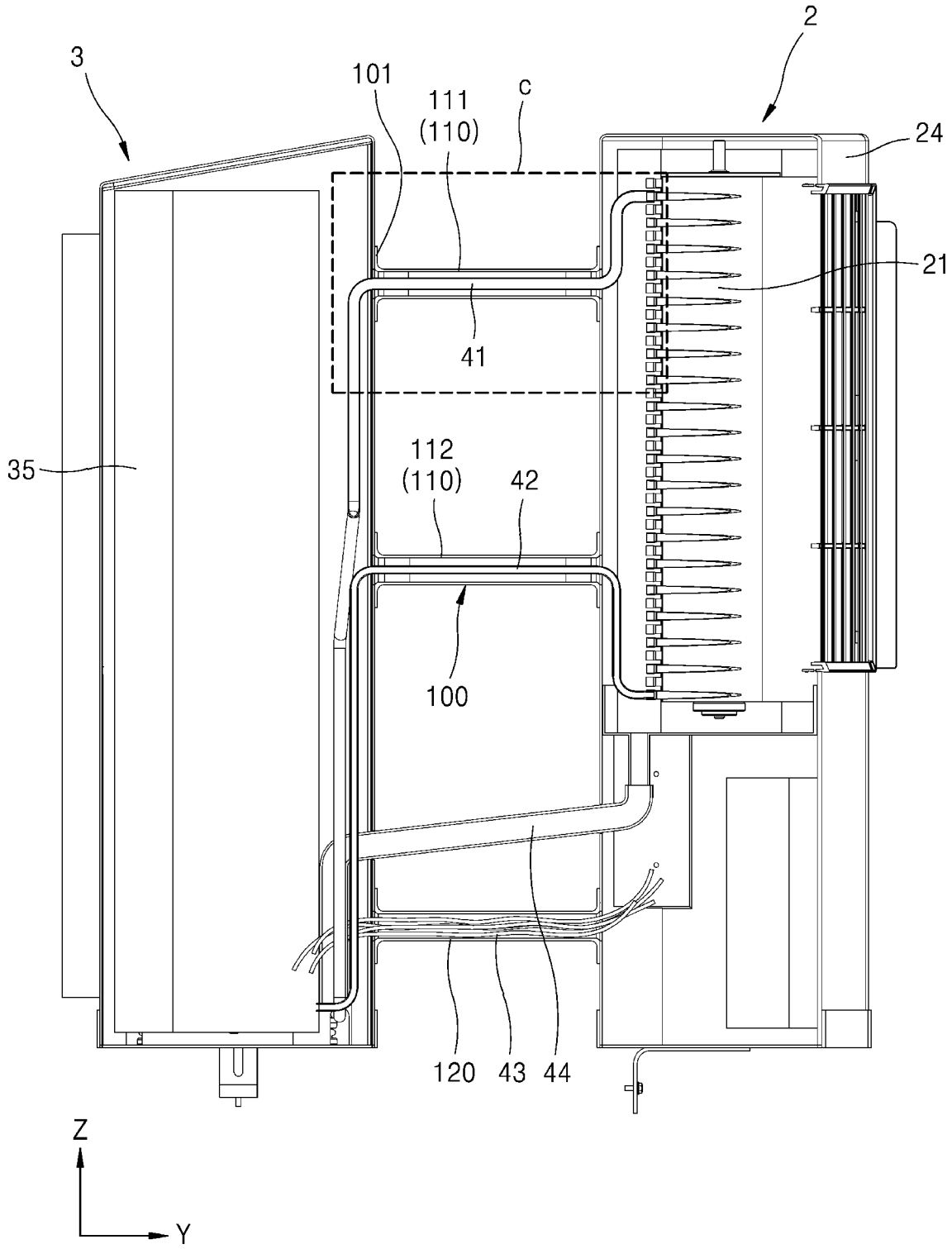
FIG. 5 is a cross-sectional view of a connection support module of the window type air conditioner of FIG. 4.
Figure 6A:
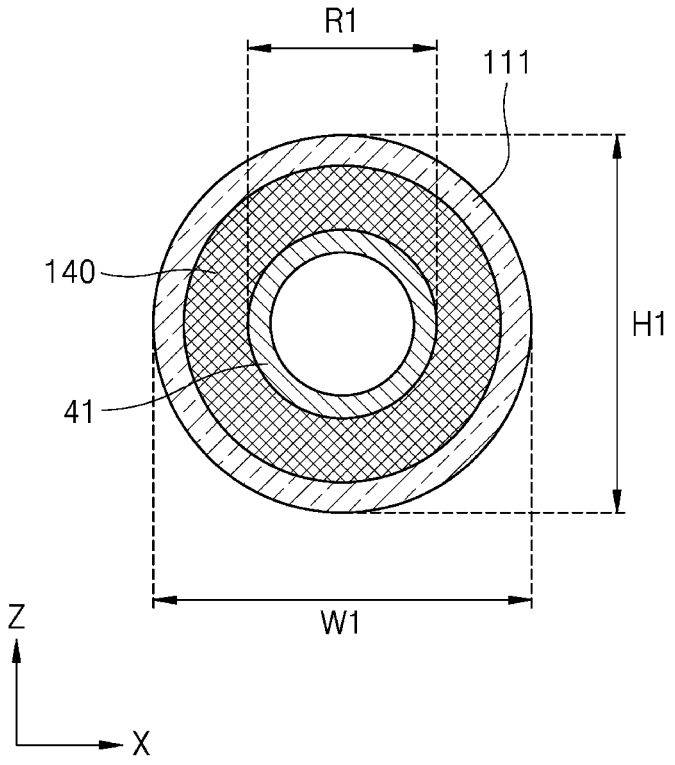
FIG. 6A is a cross-sectional view of a first refrigerant connection frame of FIG. 5.
Figure 6B:
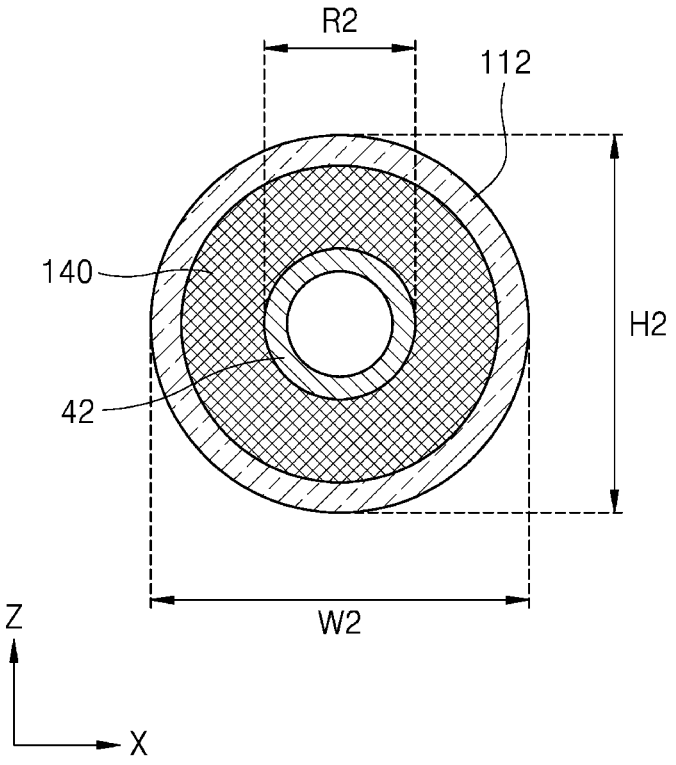
FIG. 6B is a cross-sectional view of a second refrigerant connection frame of FIG. 5.
Figure 7:
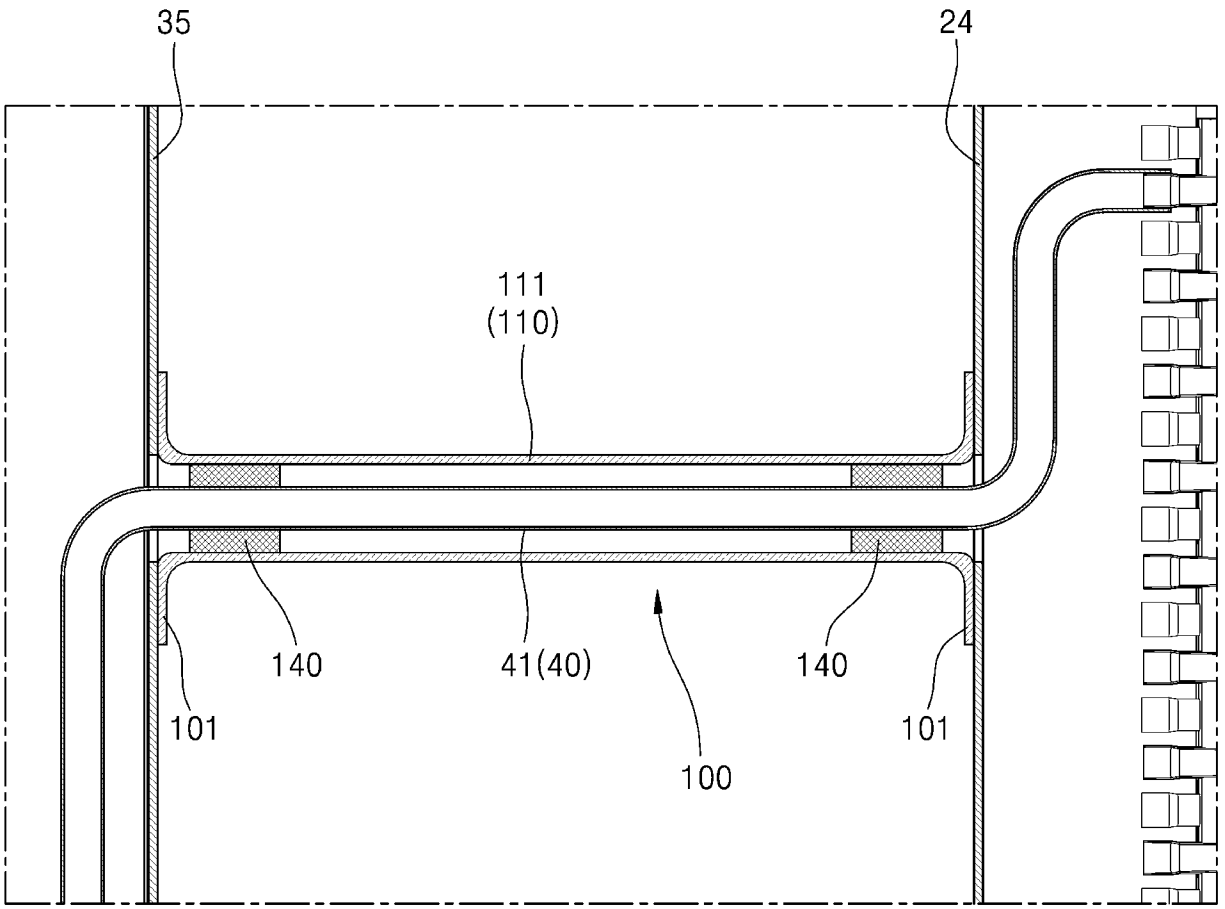
FIG. 7 is an enlarged view of a region C which is a partial region of FIG. 5.

FIG. 5 is a cross-sectional view of the connection support module 100 of the window type air conditioner 1 of FIG. 4. FIG. 6A is a cross-sectional view of a first refrigerant connection frame 111 of FIG. 5, and FIG. 6B is a cross-sectional view of a second refrigerant connection frame 112 of FIG. 5. FIG. 7 is an enlarged view of a region C which is a partial region of FIG. 5.

Referring to FIG. 5, the connection support module 100 according to an embodiment of the disclosure may be configured to enable connection of fluid between the indoor module 2 and the outdoor module 3. For example, the connection support module 100 may have a hollow structure so that the refrigerant pipe 40 is disposed therein.

For example, the connection support module 100 may include a first connection rod 110 in which the refrigerant pipe 40 is accommodated. The inner circumferential surface of the first connection rod 110 may be spaced apart from the edge, or outer circumferential surface, of the refrigerant pipe 40.

The first connection rod 110 may include a first refrigerant connection frame 111 surrounding the first refrigerant pipe 41 and a second refrigerant connection frame 112 surrounding the second refrigerant pipe 42. The first refrigerant connection frame 111 and the second refrigerant connection frame 112 may be aligned in an up-down direction Z. The first refrigerant connection frame 111 and the second refrigerant connection frame 112 may be disposed to be spaced apart from each other in the up-down direction Z.

Referring to FIGS. 5, 6A and 6B, the width of the first connection rod 110 may be less than or equal to 5 times than the diameter of the refrigerant pipe 40. The width of the first connection rod 110 may be less than or equal to 3 times the diameter of the refrigerant pipe 40. For example, a width W1 of the first refrigerant connection frame 111 may be less than or equal to 5 times a diameter R1 of the first refrigerant pipe 41. For example, the width W1 of the first refrigerant connection frame 111 may be less than or equal to 3 times the diameter R1 of the first refrigerant pipe 41. For example, a width W2 of the second refrigerant connection frame 112 may be less than or equal to 5 times a diameter R2 of the second refrigerant pipe 42. For example, the width W2 of the second refrigerant connection frame 112 may be less than or equal to 3 times the diameter R2 of the second refrigerant pipe 42. The diameter R1 of the first refrigerant pipe 41 may be greater than the diameter R2 of the second refrigerant pipe 42. The width of the first connection rod 110 is greater than the diameter of the refrigerant pipe 40. Here, the width may be defined as a width in a left-right direction X perpendicular to both a front-back direction Y and the up-down direction Z.

The height of the first connection rod 110 may be less than or equal to 5 times the width of the first connection rod 110. The height of the first connection rod 110 may be less than or equal to 3 times the width of the first connection rod 110. For example, a height H1 of the first refrigerant connection frame 111 may be less than or equal to 5 times the width W1 of the first refrigerant connection frame 111. For example, the height H1 of the first refrigerant connection frame 111 may be less than or equal to 3 times the width W1 of the first refrigerant connection frame 111. For example, a height H2 of the second refrigerant connection frame 112 may be less than or equal to 5 times the width W2 of the second refrigerant connection frame 112. For example, the height H2 of the second refrigerant connection frame 112 may be less than or equal to 3 times the width W2 of the second refrigerant connection frame 112. The height of the first connection rod 110 may be equal to or greater than the width of the first connection rod 110. Here, the height may be defined as a height in the up-down direction Z.

Referring back to FIG. 5, the connection support module 100 according to an embodiment of the disclosure may be configured to enable electrical connection between the indoor module 2 and the outdoor module 3. For example, the connection support module 100 may further include a hollow structure so that a wire 43 is disposed therein. For example, the connection support module 100 may further include a second connection rod 120 surrounding the wire 43. The second connection rod 120 may have a structure surrounding the circumference of the wire 43. Although not shown, a communication line may be disposed inside the second connection rod 120.

The second connection rod 120 may be aligned with the first connection rod 110 in the up-down direction Z. For example, the second connection rod 120 may be disposed to be spaced apart from the first refrigerant connection frame 111 and the second refrigerant connection frame 112 in the up-down direction Z. The first connection rod 110 and the second connection rod 120 are aligned in the up-down direction Z, and thus, the gap between the window 1000 and the window frame 1010 due to the connecting supporting module 100 may be reduced.

Referring to FIGS. 6A and 7, the connection support module 100 may have a structure spaced apart from the refrigerant pipe 40 accommodated therein. For example, a space may exist between the refrigerant pipe 40 and the first connection rod 110. For example, the refrigerant pipe 40 and the first connection rod 110 may be spaced apart so as not to contact each other. A space may exist between the first refrigerant pipe 41 and the first refrigerant connection frame 111. The first refrigerant pipe 41 and the first refrigerant connection frame 111 may be spaced apart so as not to contact each other.

Inside the first connection rod 110, a sealing member 140 disposed between the outer circumferential surface of the refrigerant pipe 40 and the inner circumferential surface of the first connection rod 110 may be included. The sealing member 140 may have a ring structure surrounding the refrigerant pipe 40. The sealing member 140 may seal between the refrigerant pipe 40 and the first connection rod 110. The sealing member 140 may seal between the first refrigerant pipe 41 and the first refrigerant connection frame 111.

The sealing member 140 may include a material capable of elastic deformation. For example, the material of the sealing member 140 may be rubber or synthetic resin.

In the connection support module 100, the sealing member 140 may surround the edge of the refrigerant pipe 40, and the first connection rod 110 may surround the edge of the sealing member 140. For example, the sealing member 140 may surround the edge of the first refrigerant pipe 41, and the first refrigerant connection frame 111 may surround the edge of the sealing member 140.

The sealing member 140 may be inserted between the refrigerant pipe 40 and the first connection rod 110. The sealing member 140 may be inserted between the first refrigerant pipe 41 and the first refrigerant connection frame 111. The sealing member 140 is inserted between the refrigerant pipe 40 and the first connection rod 110, thereby preventing a gap through which noise is transferrable between the refrigerant pipe 40 and the first connection rod 110 from being generated. In this way, the sealing member 140 may seal the space between the refrigerant pipe 40 and the first connection rod 110, thereby preventing noise from entering between the refrigerant pipe 40 and the first connection rod 110. Thus, noise generated by the outdoor module 3 may be prevented from being transferred through the inner space of the first connection rod 110. For example, noise generated by the compressor 31 of the outdoor module 3 may be prevented from being transferred through the inner space of the first connection rod 110.

In addition, the sealing member 140 may perform a function of maintaining the gap between the refrigerant pipe 40 and the first connection rod 110. For example, a pair of sealing members 140 may be disposed to be spaced apart in the front-back direction Y inside the first connection rod 110, and a gap between the outer circumferential surface of the refrigerant pipe 40 and the inner circumferential surface of the first connection rod 110 may be maintained. The gap between the refrigerant pipe 40 and the first connection rod 110 is maintained by the sealing member 140, and thus, corrosion caused by contact between the refrigerant pipe 40 and the first connection rod 110 may be prevented.

Materials of the refrigerant pipe 40 and the first connection rod 110 may be different from each other. For example, the material of the refrigerant pipe 40 may be copper (Cu), and the material of the first connection rod 110 may be steel. When the refrigerant pipe 40 and the first connection rod 110 having different materials are in contact with each other, dissimilar metal corrosion may occur in at least one of the refrigerant pipe 40 or the first connection rod 110. On the other hand, the contact between the refrigerant pipe 40 and the first connection rod 110 is blocked by the sealing member 140 in the connection support module 100 according to an embodiment of the disclosure, and thus, occurrence of dissimilar metal corrosion may be prevented. In addition, the sealing member 140 may perform a function of blocking noise generated when the refrigerant pipe 40 and the first connection rod 110 are in contact with each other.

In addition, the sealing member 140 may perform a function of blocking transfer of vibration generated by the outdoor module 3 to the indoor module 2. For example, the sealing member 140 may block transfer of vibration generated by the compressor 31 of the outdoor module 3 to the indoor module 2 through the connection support module 100.

As an example, the first refrigerant pipe 41 connected to the compressor 31 may pass through the connection support module 100 and be connected to the indoor heat exchanger 21. The compressor 31 may not only generate noise but also generate vibration when operating. Accordingly, vibration generated by the compressor 31 may be transferred to the indoor module 2 along the first refrigerant pipe 41. Vibration transferred to the indoor module 2 may act as a cause of new noise inside the indoor module 2, depending on circumstances.

In the connection support module 100 according to an embodiment of the disclosure, the sealing member 140 is disposed to contact the first refrigerant pipe 41, and thus, the vibration transferred along the first refrigerant pipe 41 may be absorbed by the sealing member 140. Accordingly, vibration transferred from the compressor 31 to the first refrigerant pipe 41 may be blocked from being transferred to the indoor module 2.

As described above, the connection support module 100 may be designed to minimize transfer of noise and vibration from the outdoor module 3 to the indoor module 2. For example, the width of the connection support module 100 may be smaller than or equal to 5 times the diameter of the refrigerant pipe 40. For example, the width of the connection support module 100 may be smaller than or equal to 3 times the diameter of the refrigerant pipe 40. For example, the width of the first connection rod 110 may be smaller than or equal to 5 times the diameter of the refrigerant pipe 40. For example, the width of the first connection rod 110 may be smaller than or equal to 3 times the diameter of the refrigerant pipe 40. For example, the width of the first connection rod 110 may be smaller than or equal to 5 times the diameter of the first refrigerant pipe 41. For example, the width of the first connection rod 110 may be smaller than or equal to 3 times the diameter of the first refrigerant pipe 41.

The height of the connection support module 100 may be smaller than or equal to 5 times the width of the connection support module 100. For example, the height of the first connection rod 110 may be 5 times or less than the width of the first connection rod 110. For example, the height of the first connection rod 110 may be smaller than or equal to 3 times the width of the first connection rod 110. The height of the first refrigerant connection frame 111 may be smaller than or equal to 5 times the width of the first refrigerant connection frame 111. The height of the first refrigerant connection frame 111 may be smaller than or equal to 3 times the width of the first refrigerant connection frame 111. The height of the second refrigerant connection frame 112 may be smaller than or equal to 5 times the width of the second refrigerant connection frame 112. The height of the second refrigerant connection frame 112 may be smaller than or equal to 3 times the width of the second refrigerant connection frame 112.

The first refrigerant connection frame 111, the second refrigerant connection frame 112, and the second connection rod 120 are disposed to be spaced apart from each other in the up-down direction Z in the connection support module 100 according to an embodiment of the disclosure described above, but the arrangement and shape of the connection support module 100 is not limited thereto and may vary.

Figure 8A:
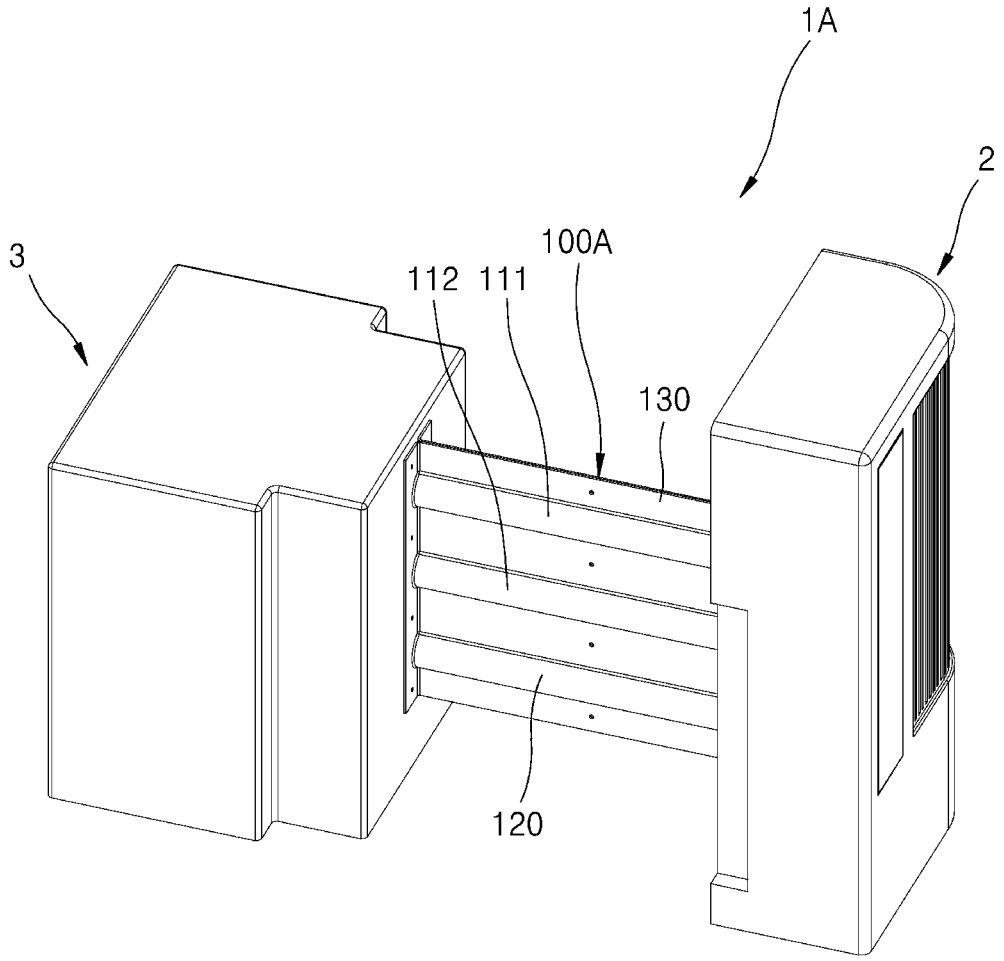
FIG. 8A is a perspective view illustrating a connection support module of a window type air conditioner according to an embodiment of the disclosure.
Figure 8B:
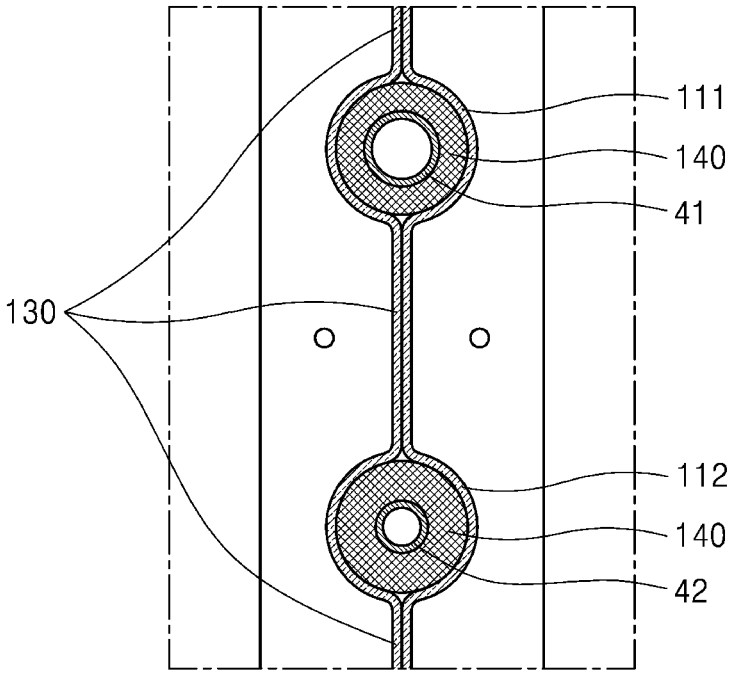
FIG. 8B is a cross-sectional view of the connection support module of FIG. 8A.
Figure 9A:
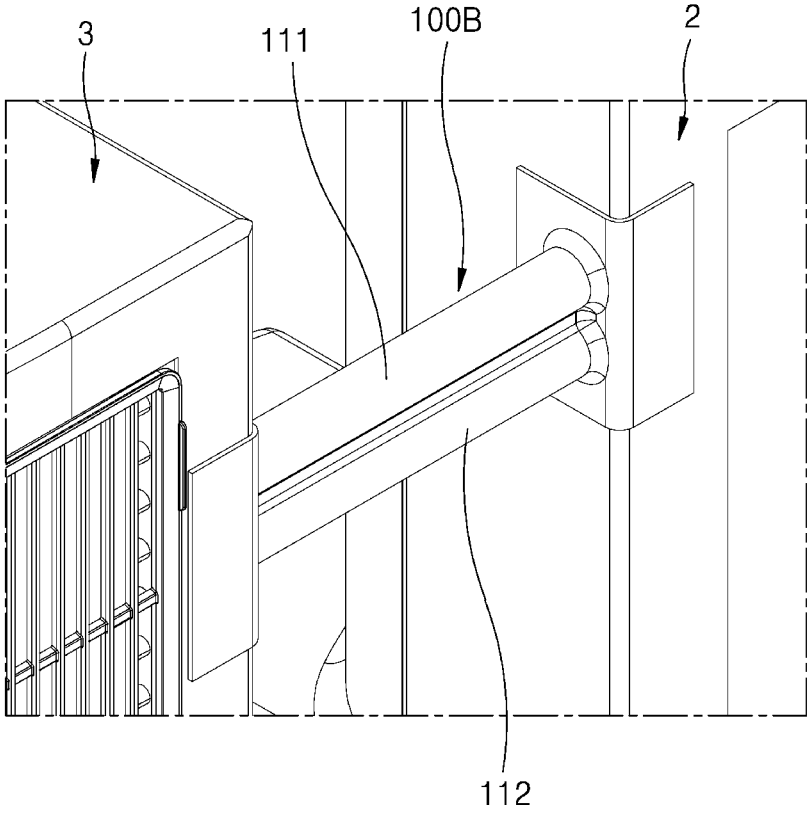
FIG. 9A is a partial perspective view illustrating a connection support module of a window type air conditioner according to an embodiment of the disclosure.

FIG. 8A is a perspective view illustrating a connection support module 100A of a window type air conditioner 1A according to an embodiment of the disclosure, and FIG. 8B is a cross-sectional view of the connection support module 100A of FIG. 8A. FIG. 9A is a partial perspective view illustrating a connection support module 100B of the window type air conditioner 1 according to an embodiment of the disclosure, and FIG. 9B is a cross-sectional view of a connection support module 100B of FIG. 9A.

For example, referring to FIGS. 8A and 8B, the connection support module 100A according to an embodiment of the disclosure includes the first refrigerant connection frame 111, the second refrigerant connection frame 112, the second connection rod 120, and a reinforcing plate 130. The reinforcing plate 130 may be disposed with the first refrigerant connection frame 111, the second refrigerant connection frame 112, and the second connection rod 120 in the up-down direction Z. The width of the reinforcing plate 130 may be smaller than the width of each of the first refrigerant connection frame 111, the second refrigerant connection frame 112, and the second connection rod 120.

The reinforcing plate 130 may be disposed on at least one of the upper portion of the first refrigerant connection frame 111, between the first refrigerant connection frame 111 and the second refrigerant connection frame 112, between the second refrigerant connection frame 112 and the second connection rod 120, or the lower portion of the second connection rod 120. For example, the reinforcing plate 130 may be disposed on the upper portion of the first refrigerant connection frame 111 and between the first refrigerant connection frame 111 and the second refrigerant connection frame 112. For example, the reinforcing plate 130 may be disposed between the second refrigerant connection frame 112 and the second connection rod 120. For example, the reinforcing plate 130 may be disposed on the lower portion of the second connection rod 120. The refrigerant pipe 40 and the wire 43 do not pass through the reinforcing plate 130, and thus, the reinforcing plate 130 may reinforce the strength of the connection support module 100 without transferring noise.

Figure 9B:
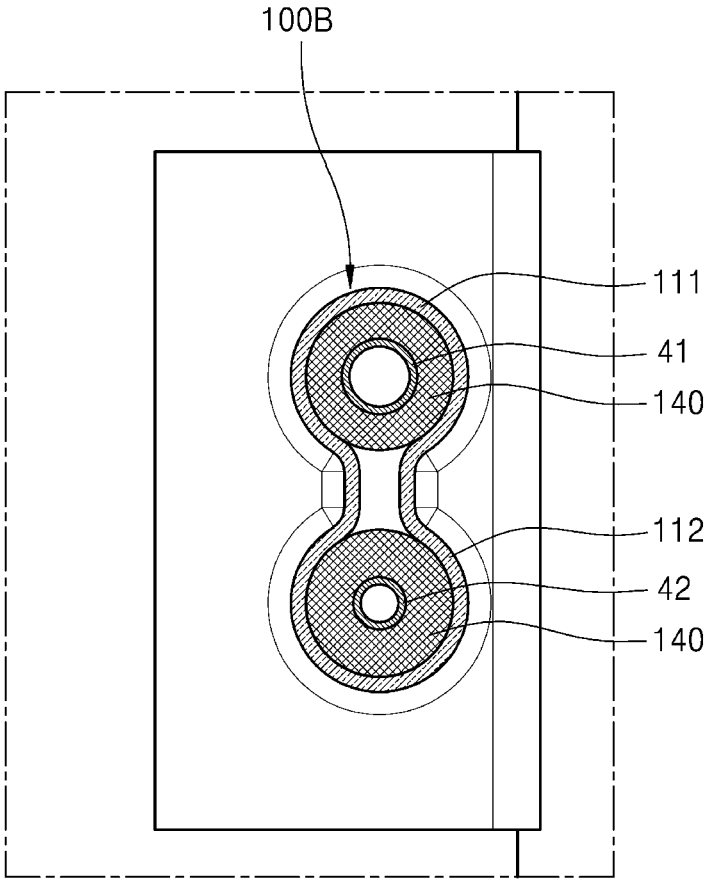
FIG. 9B is a cross-sectional view of the connection support module of FIG. 9A.

For example, referring to FIGS. 9A and 9B, in the connection support module 100B according to an embodiment of the disclosure, the first refrigerant connection frame 111 and the second refrigerant connection frame 112 may also be disposed in contact with each other in the up-down direction Z. For example, the first refrigerant connection frame 111 and the second refrigerant connection frame 112 may be connected to each other in the up-down direction Z. An inner space of the first refrigerant connection frame 111 and an inner space of the second refrigerant connection frame 112 may be connected to each other. The first refrigerant connection frame 111 and the second refrigerant connection frame 112 may be a single body.

Meanwhile, as described above, when the structure of each of the connection support modules 100, 100A, and 100B is designed in consideration of transfer of noise and vibration, the window type air conditioner 1 may be vulnerable to external forces acting during transportation or movement. For example, when an external force is applied to the outdoor module 3 or the indoor module 2 of the window type air conditioner 1, the positions of the outdoor module 3 and the indoor module 2 may be displaced so that the connection support module 100 may be bent or twisted.

Considering this fact, the window type air conditioner 1 according to an embodiment of the disclosure may further include a temporary support portion 150 (see FIG. 10) capable of securing a certain strength before being installed on the window frame 1010.

Figure 10:
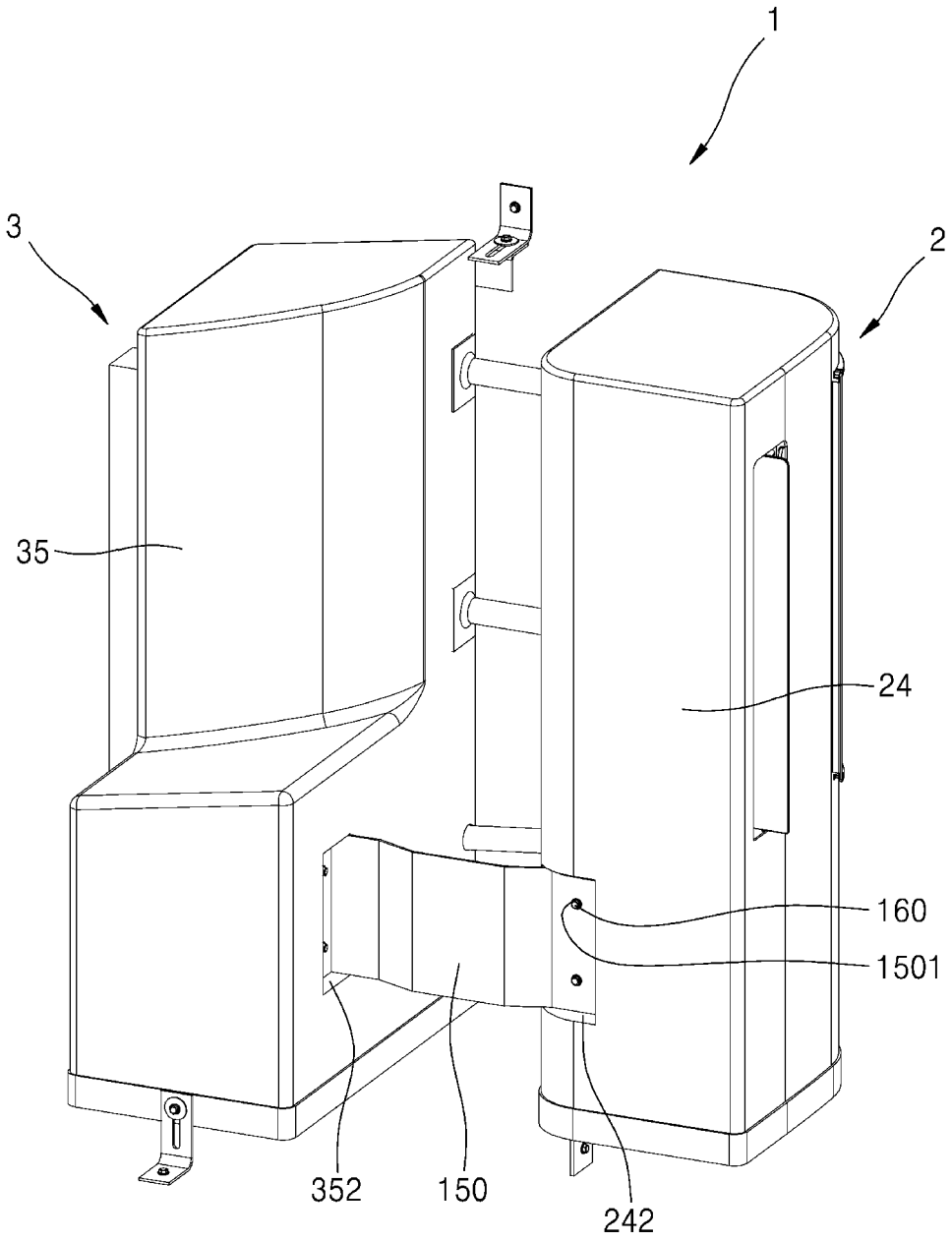
FIG. 10 is a perspective view illustrating a temporary support portion of a window type air conditioner according to an embodiment of the disclosure.

FIG. 10 is a perspective view illustrating the temporary support portion 150 of the window type air conditioner 1 according to an embodiment of the disclosure. Referring to FIG. 10, the window type air conditioner 1 according to an embodiment of the disclosure may further include the temporary support portion 150 removed before being installed on the window frame 1010.

The temporary support portion 150 may be detachably fixed to the indoor module 2 and the outdoor module 3. The temporary support portion 150 may be detachably fixed to the outdoor housing 35 and the indoor housing 24. For example, the temporary support portion 150 may be detachably fixed to the indoor module 2 and the outdoor module 3 by a fastening member 160. For example, positioning grooves 242 and 352 may be respectively provided in the indoor housing 24 and the outdoor housing 35, and first fastening holes 241 and 351 (see FIG. 4) may be respectively provided in the positioning grooves 242 and 352. The temporary support portion 150 may include a second fastening hole 1501 corresponding to the first fastening hole 241 of the indoor housing 24 and the first fastening hole 351 of the outdoor housing 35.

The temporary support portion 150 and the indoor housing 24 may be fixed to each other by assembling the fastening member 160 into the second fastening hole 1501 of the temporary support portion 150 and the first fastening hole 241 of the indoor housing 24. The temporary support portion 150 and the outdoor housing 35 may be fixed to each other by assembling the fastening member 160 into the second fastening hole 1501 of the temporary support portion 150 and the first fastening hole 351 of the outdoor housing 35. One end of the temporary support portion 150 may be fixed to the indoor housing 24 and the other end may be fixed to the outdoor housing 35.

The temporary support portion 150 may be configured to have a certain strength. For example, the material of the temporary support portion 150 may include steel. For example, the temporary support portion 150 may include galvanized steel. For example, the temporary support portion 150 may be a hot-dip galvanized steel plate. However, the material and shape of the temporary support portion 150 are not limited thereto, and may vary as long as the material and structure have a certain strength.

The temporary support portion 150 may be separated from the indoor module 2 and the outdoor module 3 before installing the window type air conditioner 1 on the window frame 1010. For example, before installing the window type air conditioner 1, a worker may remove the temporary support portion 150 by loosening the fastening member 160. For example, as the fastening member 160 is separated from the first fastening holes 241 and 351 and the second fastening hole 1501, the temporary support portion 150 may be separated from the indoor housing 24 and the outdoor housing 35.

When the temporary support portion 150 is separated from the window type air conditioner 1, as shown in FIG. 4, the window type air conditioner 1 does not include the temporary support portion 150, and the fastening holes 241 and 351 may be present in the outdoor housing 35 and the indoor housing 24.

When the window type air conditioner 1 is installed without separating the temporary support portion 150, the gap between the window 1000 and the window frame 1010 may increase due to the temporary support portion 150. On the other hand, the temporary support portion 150 is separated before installing the window type air conditioner 1, thereby preventing the gap between the window 1000 and the window frame 1010 from increasing due to the temporary support portion 150.

As described above, by separating the temporary support portion 150 before installing the window type air conditioner 1, a certain strength may be secured during a transportation process of the window type air conditioner 1, and, when installing window type air conditioner 1 on the window frame 1010, the gap between the window 1000 and the window frame 1010 may be prevented from increasing.

The temporary support portion 150 may be disposed to be spaced apart from the connection support module 100. For example, the temporary support portion 150 may be disposed to be spaced apart from the connection support module 100 in the left-right direction X.

For example, the temporary support portion 150 may be disposed at a position different from at least a part of the connection support module 100 in the up-down direction Z. For example, the temporary support portion 150 may be disposed at a position different from the first connection rod 110 in the up-down direction Z. For example, when the first connection rod 110 connects the upper right portions of the outdoor module 3 and the indoor module 2, the temporary support portion 150 may be arranged to connect the lower left portions of the outdoor module 3 and the indoor module 2.

As described above, the temporary support portion 150 spaced apart from the connection support module 100 supports the indoor module 2 and the outdoor module 3, and thus, when an external force acts, the distortion of the module 2 and the outdoor module 3 with respect to the connection support module 100 may be prevented.

Meanwhile, the arrangements, structures, etc., of the temporary support portion 150 and the connection support module 100 according to an embodiment of the disclosure described above are examples, and accordingly, the arrangements, structures, etc., of the temporary support portion 150 and the connection support module 100 may be modified in various ways.

Figure 11:
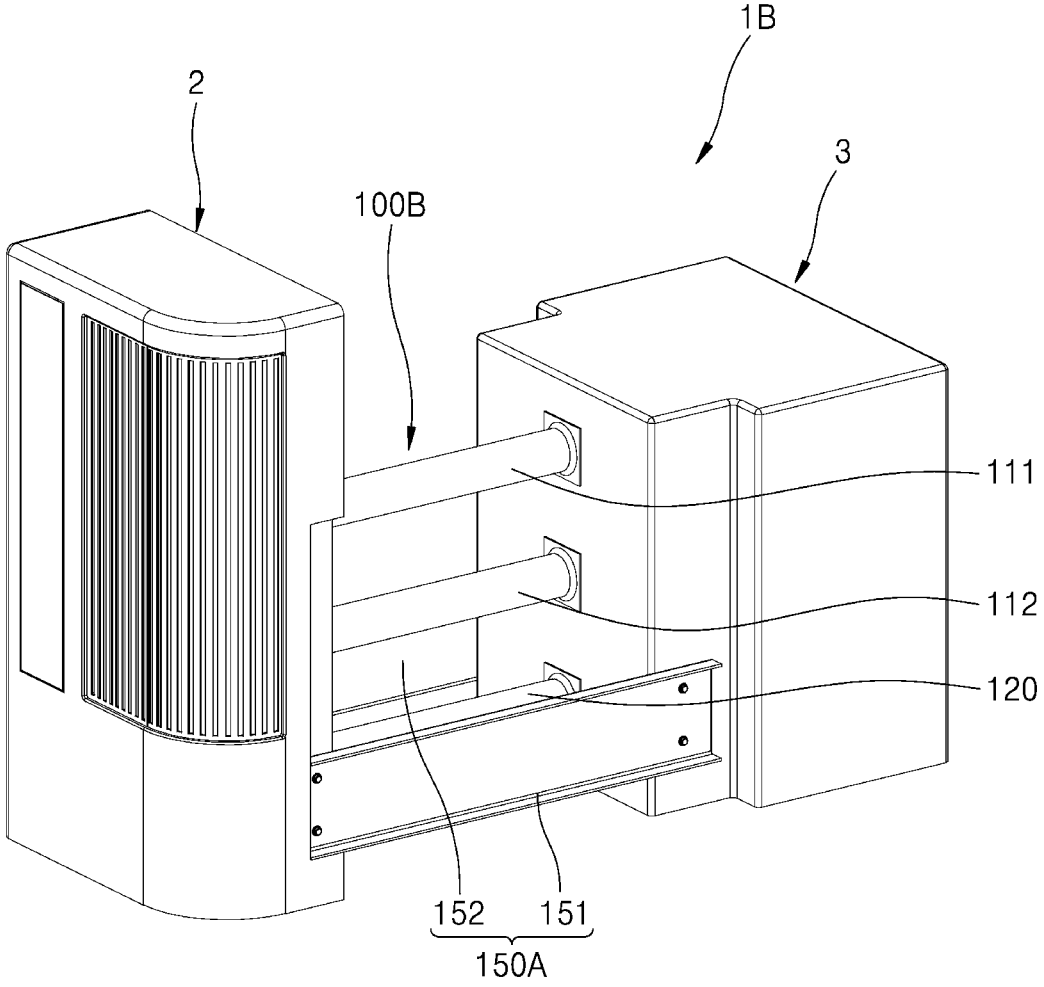
FIG. 11 is a perspective view of a window type air conditioner according to an embodiment of the disclosure.
Figure 12:
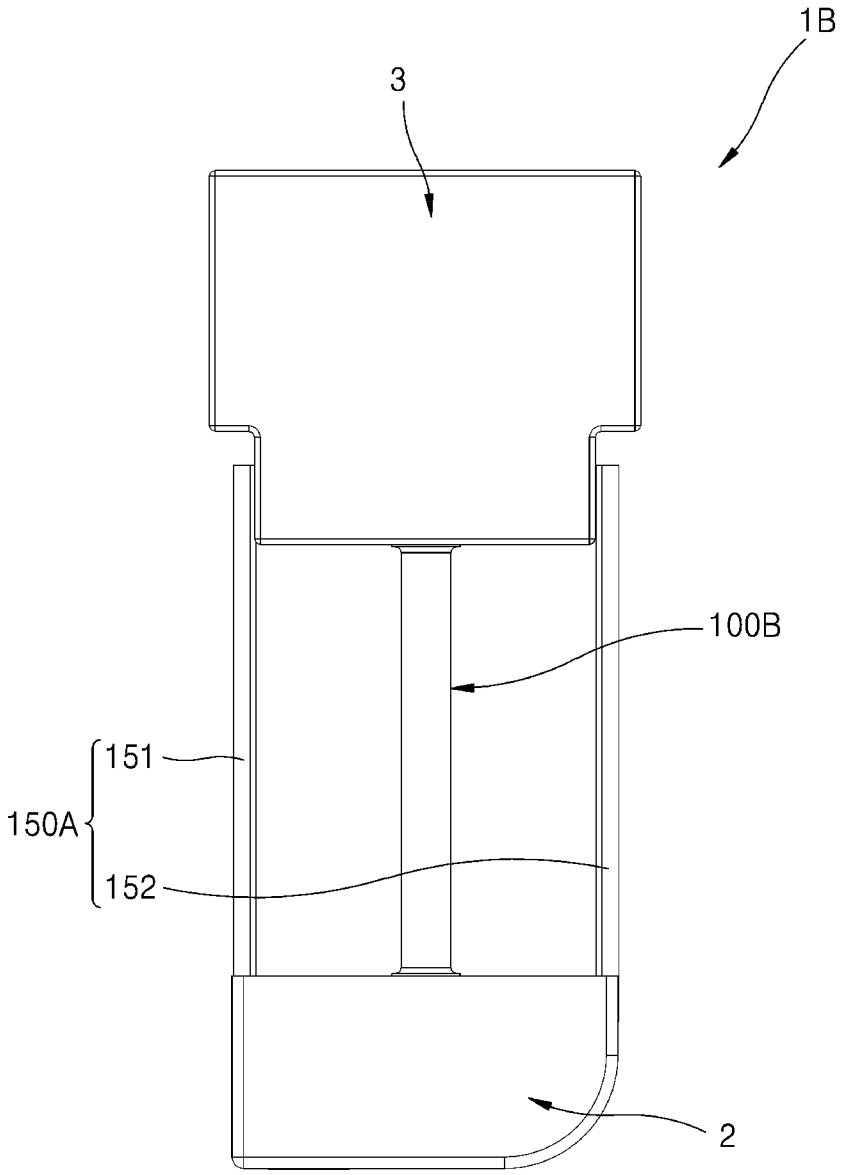
FIG. 12 is a plan view of the window type air conditioner of FIG. 11.
Figure 13:
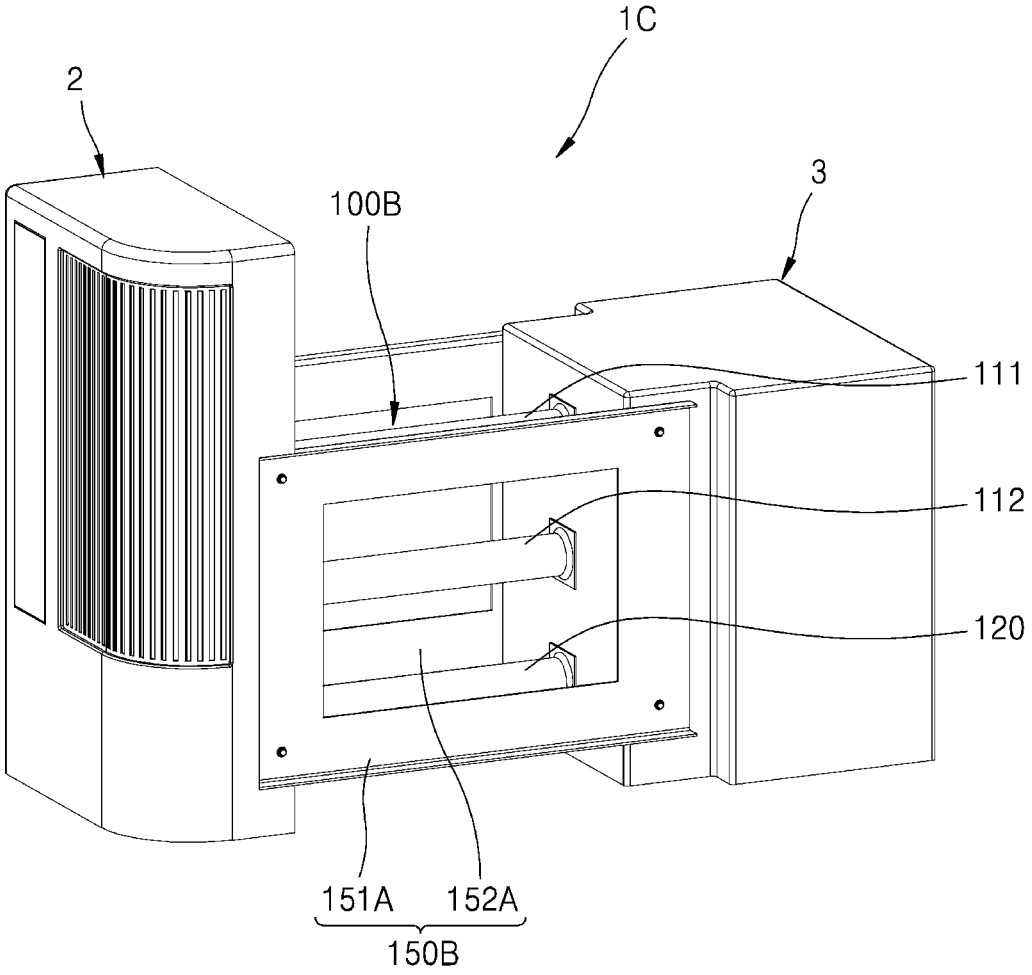
FIG. 13 is a perspective view illustrating an air conditioner according to an embodiment of the disclosure.

FIG. 11 is a perspective view of a window type air conditioner 1B according to an embodiment of the disclosure, and FIG. 12 is a plan view of the window type air conditioner 1B of FIG. 11. FIG. 13 is a perspective view illustrating a window type air conditioner 1C according to an embodiment of the disclosure.

Referring to FIGS. 11 and 12, in the window type air conditioner 1B according to an embodiment of the disclosure, a connection support module 100B may be disposed to connect central portions of the indoor module 2 and the outdoor module 3 in the left-right direction X. As described above, as the connection support module 100B is disposed in the central portion, the window type air conditioner 1B may be selectively installed on the left and right sides of the window frame 1010.

A temporary support portion 150A may include a pair of temporary plates 151 and 152 provided on both sides of the indoor module 2 and the outdoor module 3. The pair of temporary plates 151 and 152 may be disposed to be spaced apart from the connection support module 100B in the left-right direction X. The temporary plates 151 and 152 may have a structure in which their upper and lower portions are bent in consideration of strength reinforcement.

Each of the pair of temporary plates 151 and 152 may be disposed to connect the lower portions of the indoor module 2 and the outdoor module 3 in the up-down direction Z. However, the arrangements and shapes of the temporary plates 151 and 152 are not limited thereto and may vary. For example, as shown in FIG. 13, each of a pair of temporary plates 151A and 152A of a temporary support portion 150B may have a structure connecting the upper and lower portions of the indoor module 2 and the outdoor module 3.

Figure 14:
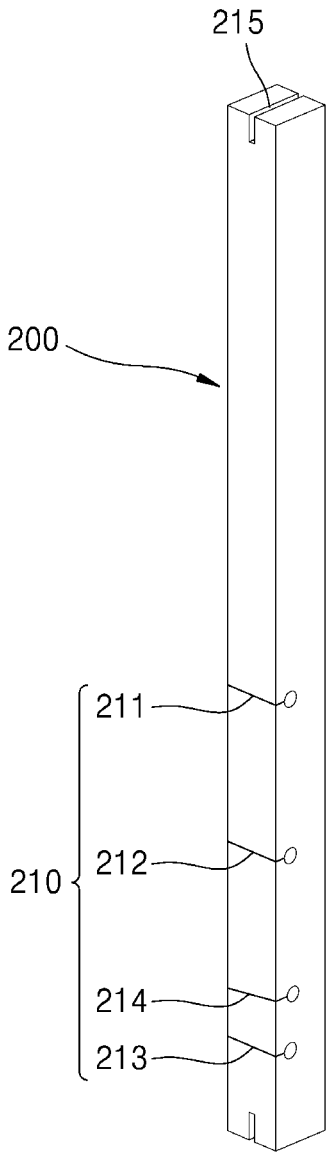
FIGS. 14 and 15 are perspective views illustrating, from different angles, a gap blocking member of a window type air conditioner according to an embodiment of the disclosure.
Figure 15:
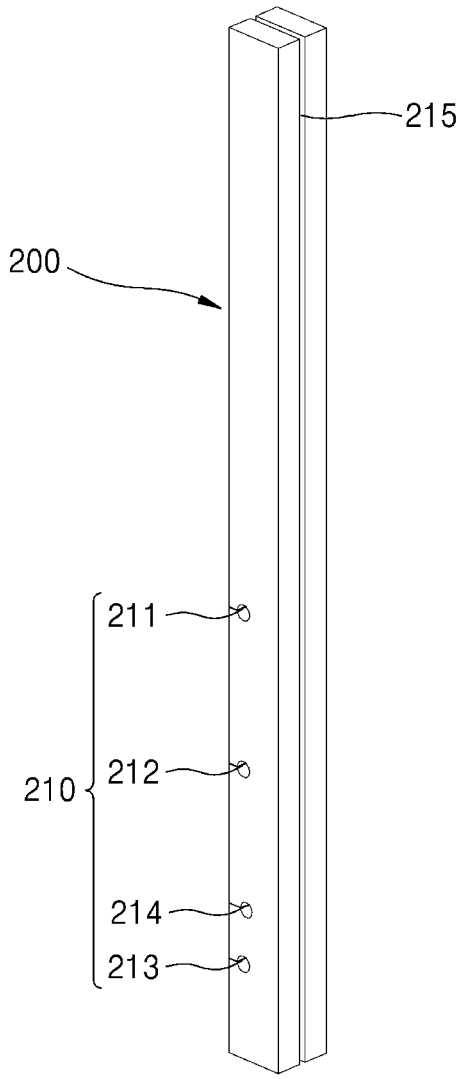
Figure 16:
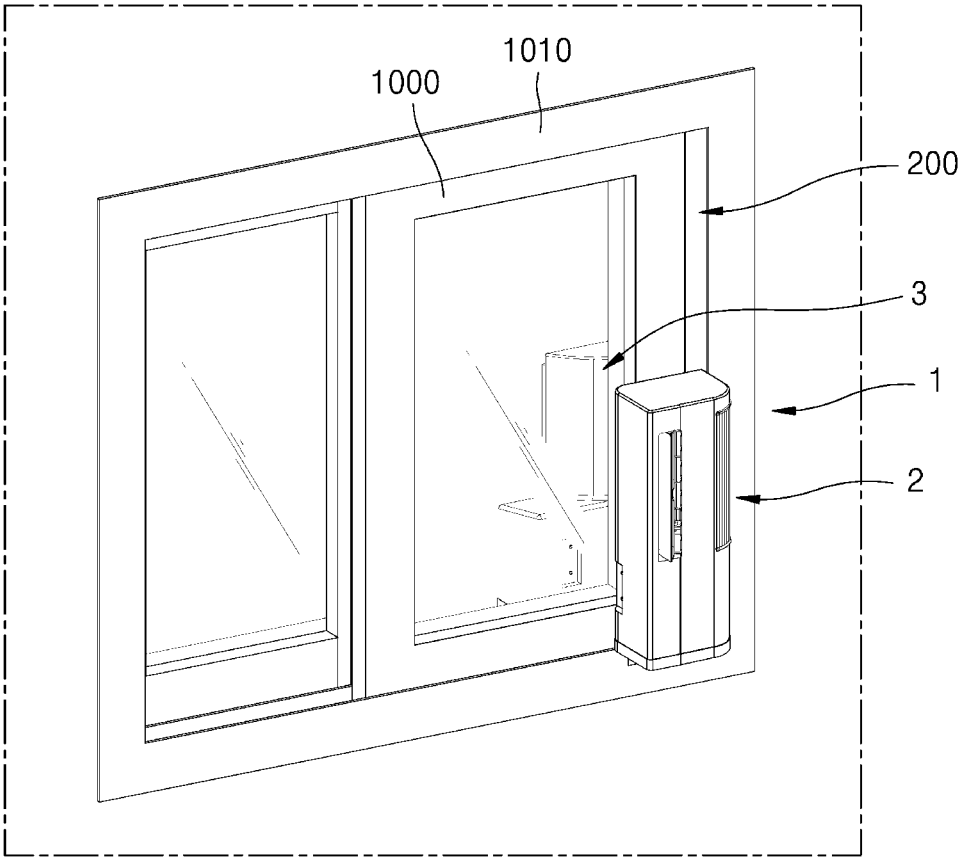
FIG. 16 is a perspective view illustrating a window type air conditioner according to an embodiment of the disclosure installed on a window frame.
Figure 17:
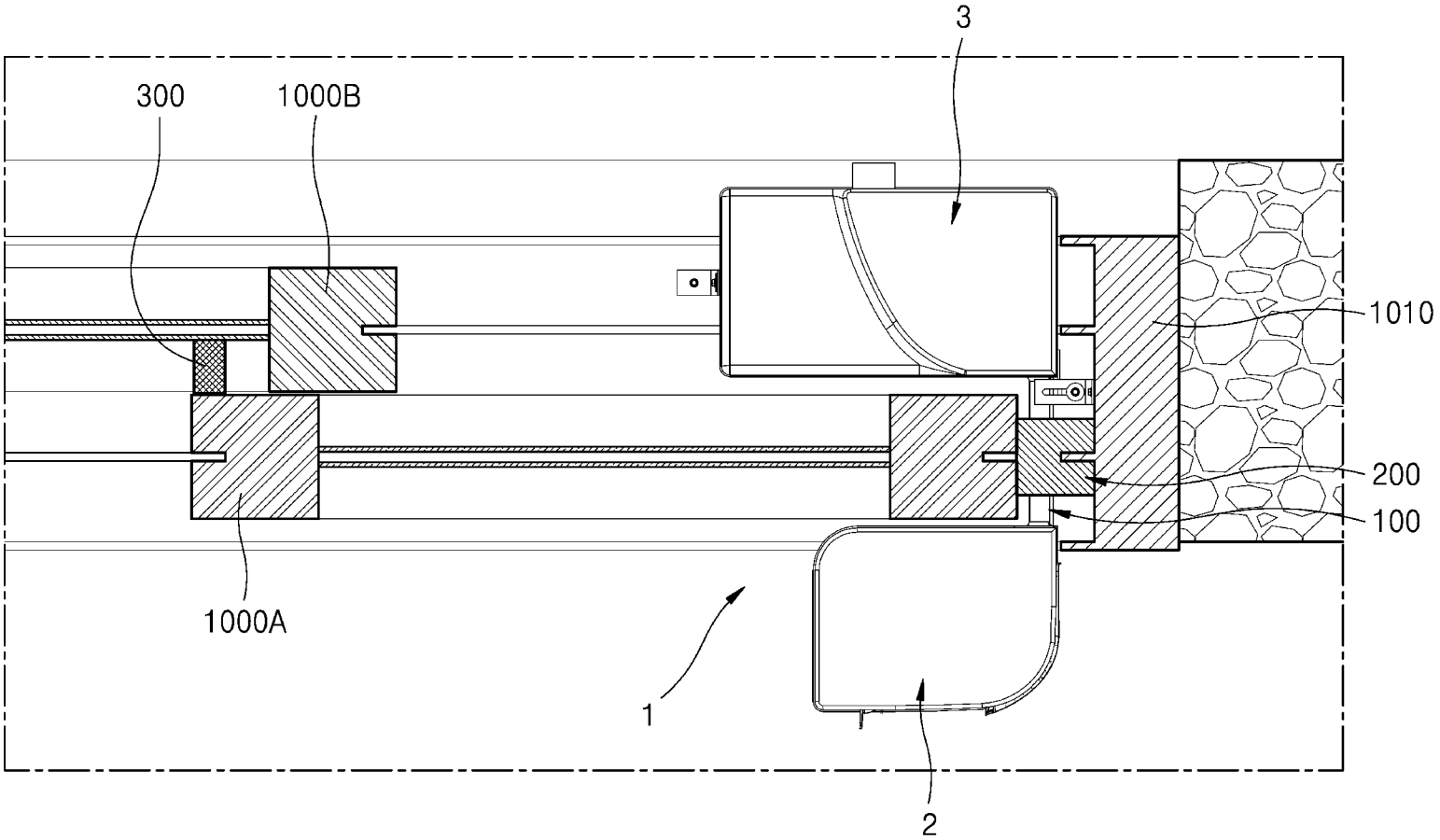
FIG. 17 is a cross-sectional view illustrating the window type air conditioner of FIG. 16.

FIGS. 14 and 15 are perspective views illustrating, from different angles, a gap blocking member 200 of the window type air conditioner 1 according to an embodiment of the disclosure. FIG. 16 is a perspective view illustrating the window type air conditioner 1 according to an embodiment of the disclosure installed on the window frame 1010. FIG. 17 is a cross-sectional view illustrating the window type air conditioner 1 of FIG. 16.

Referring to FIGS. 14 and 15, the window type air conditioner 1 according to an embodiment of the disclosure may further include the gap blocking member 200 configured to seal between the window 1000 (see FIG. 16) and the window frame 1010 (see FIG. 16).

The gap blocking member 200 includes an opening 210 through which the connection support module 100 is penetrable. For example, the gap blocking member 200 includes first openings 211 and 212 into which the first connection rod 110 is insertable and a second opening 213 into which the second connection rod 120 is insertable. The gap blocking member 200 includes a third opening 214 into which the drain hose 44 is insertable.

The gap blocking member 200 may further include a window frame coupling groove 215 for coupling to the window frame 1010. The window frame coupling groove 215 may extend in the up-down direction Z. The window frame coupling groove 215 may be an optional configuration. Accordingly, the window frame coupling groove 215 may be omitted from the gap blocking member 200.

The gap blocking member 200 may be a sound insulating material that blocks external noise. For example, the gap blocking member 200 may include a foam material. For example, the gap blocking member 200 may include polyurethane foam (PU foam) or polyethylene foam (PE foam). However, the material of the gap blocking member 200 is not limited thereto and may vary.

Referring to FIGS. 16 and 17, the gap blocking member 200 is installed between the window 1000 and the window frame 1010, and seals between the window 1000 and the window frame 1010. As a part of the window frame 1010 is inserted into the window frame coupling groove 215, the gap blocking member 200 is fixed to the window frame 1010, and the connection support module 100 and the drain hose 44 are inserted into the opening 210. Thus, the gap blocking member 200 blocks external noise from entering between the window 1000 and the window frame 1010 while passing the connection support module 100 through the opening 210.

A second gap blocking member 300 may be disposed between a window 1000B and a window 1000A. For example, the second gap blocking member 300 may be disposed between the window 1000B and the window 1000A in the front-back direction Y. Accordingly, the second gap blocking member 300 may block external noise from entering between the window 10006 and the window 1000A.

Figure 18:
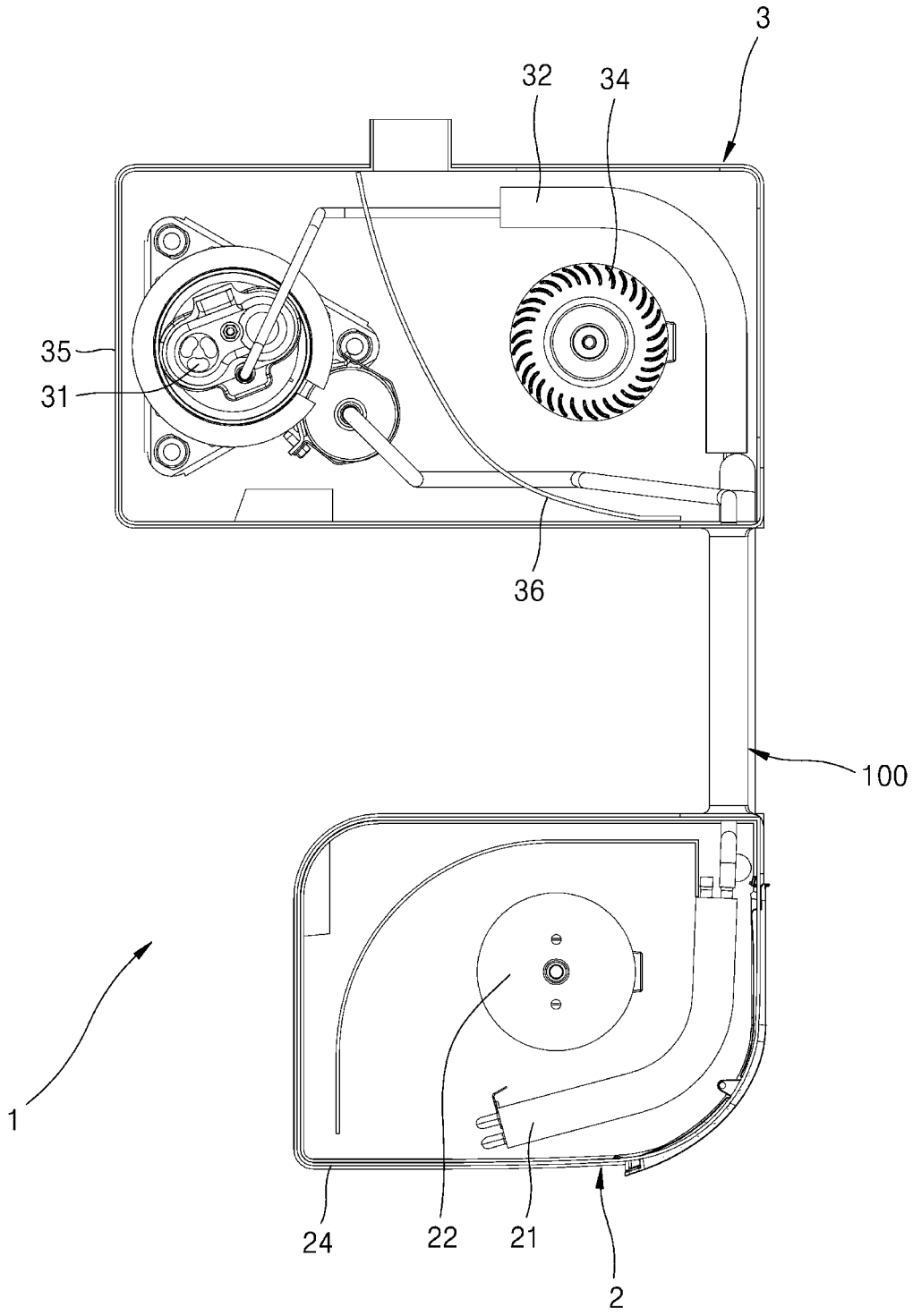
FIG. 18 is a cross-sectional view illustrating a window type air conditioner according to an embodiment of the disclosure.

FIG. 18 is a cross-sectional view illustrating the window type air conditioner 1 according to an embodiment of the disclosure.

Referring to FIGS. 4 and 18, in the window type air conditioner 1 according to an embodiment of the disclosure, the compressor 31 may be disposed inside the outdoor housing 35 far away from the connection support module 100. For example, when the connection support module 100 has a structure connected to one side of the outdoor module 3, the outdoor heat exchanger 32 may be disposed on one side adjacent to the connection support module 100 inside the outdoor module 3, and the compressor 31 may be disposed on the other side far from the connection support module 100 inside the outdoor module 3.

Inside the outdoor module 3, a barrier rib 36 may be disposed between the compressor 31 and the outdoor heat exchanger 32. The barrier rib 36 may reduce transfer of noise generated by the compressor 31 to the connection support module 100. In addition, the barrier rib 36 may guide the movement of internal air of the outdoor module 3.

Figure 20:
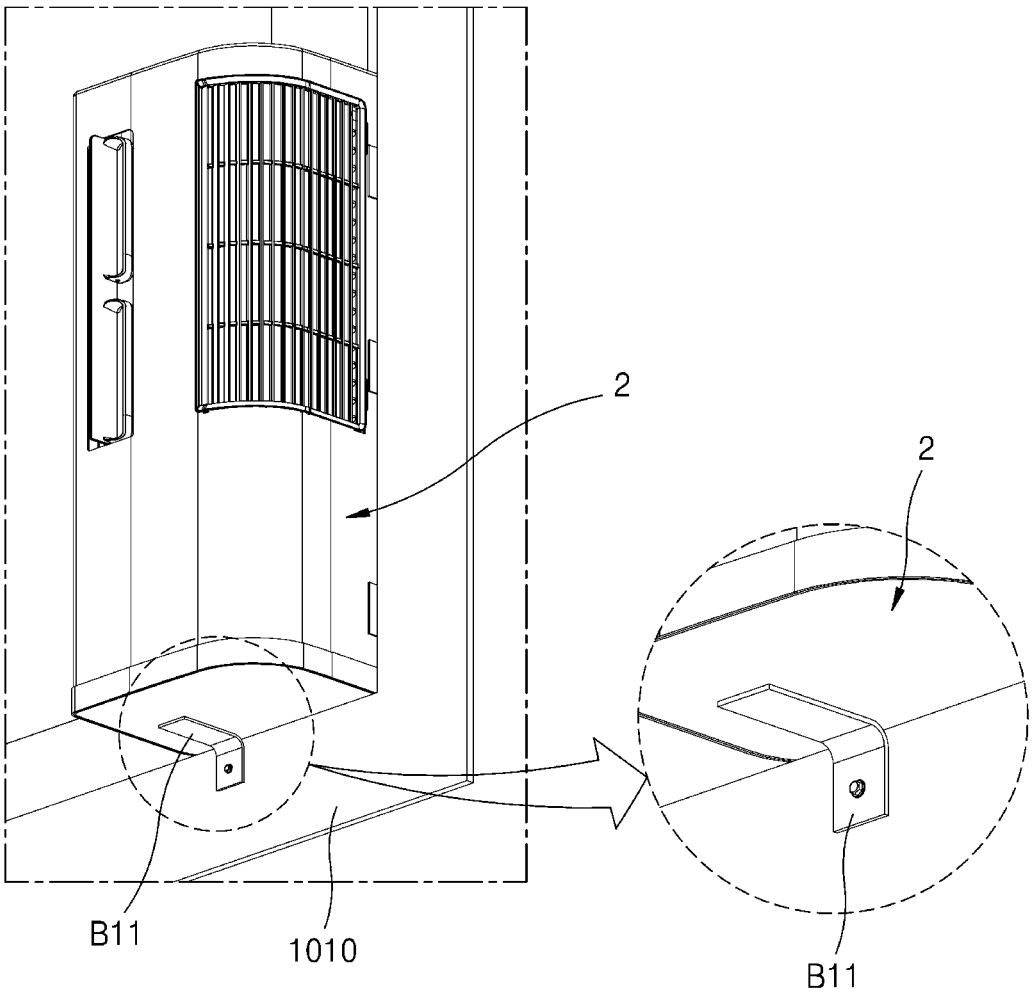
FIG. 20 illustrates a fixed indoor module of a window type air conditioner according to an embodiment of the disclosure.
Figure 21:
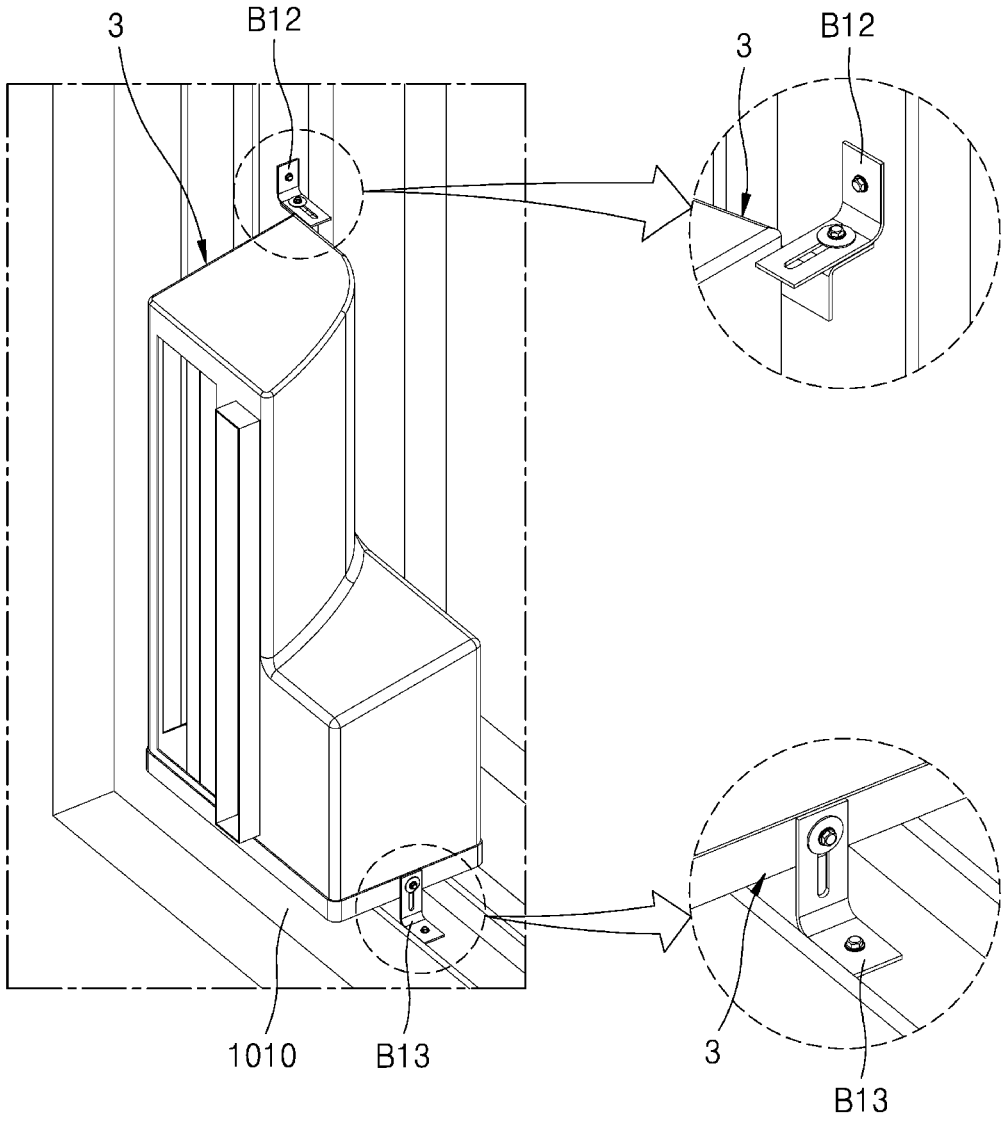
FIG. 21 illustrates a fixed outdoor module of a window type air conditioner according to an embodiment of the disclosure.

FIGS. 19A to 19F are perspective views illustrating an installation method of the window type air conditioner 1 according to an exemplary embodiment. FIG. 20 illustrates the fixed indoor module 2 of the window type air conditioner 1 according to an embodiment of the disclosure, and FIG. 21 illustrates the fixed outdoor module 3 of the window type air conditioner 1 according to an embodiment of the disclosure.

Referring to FIGS. 19A to 19F, in the installation method of the window type air conditioner 1 according to an embodiment of the disclosure, the window type air conditioner 1 according to an embodiment of the disclosure described above is first prepared. For example, the window type air conditioner 1 including the indoor module 2, the outdoor module 3, the connection support module 100, and the temporary support portion 150 is prepared.

Figure 19A:
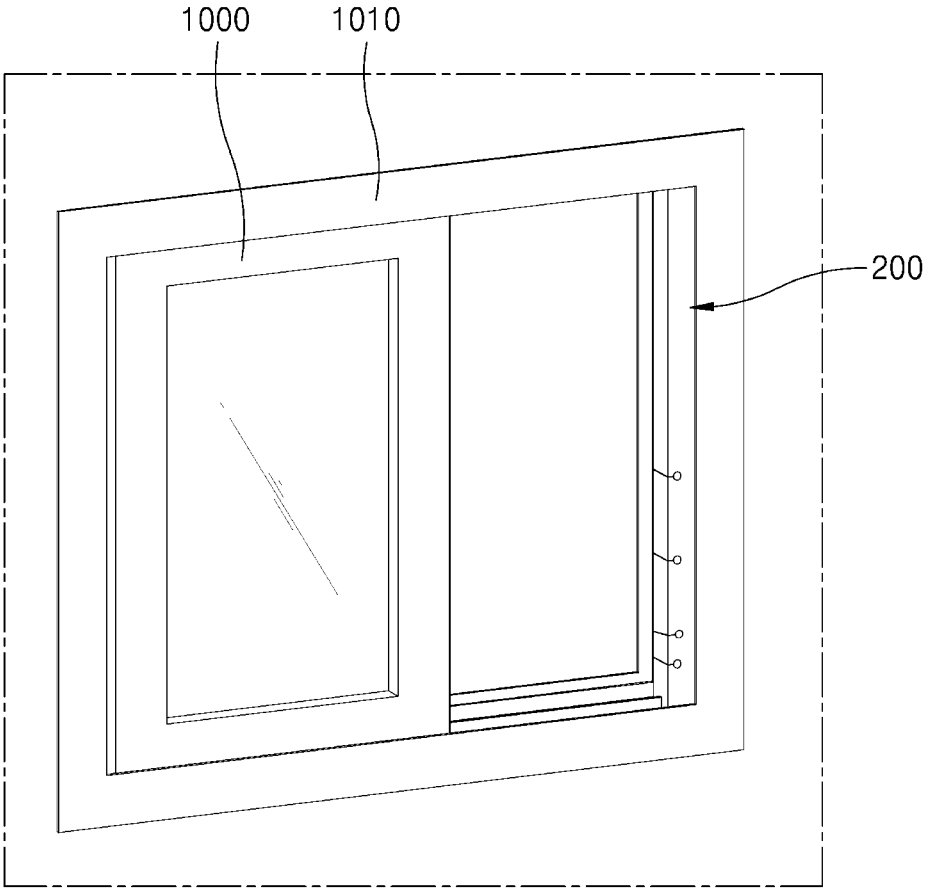
FIGS. 19A to 19F are perspective views illustrating an installation method of a window type air conditioner according to an embodiment of the disclosure.

Referring to FIG. 19A, the gap blocking member 200 may be installed on the window frame 1010. The gap blocking member 200 may be fixed to the window frame 1010 by pressing the gap blocking member 200 so that a part of the window frame 1010 is inserted into the window frame coupling groove 215 of the gap blocking member 200. The gap blocking member 200 may be adhered to the window frame 1010 as necessary.

Figure 19B:
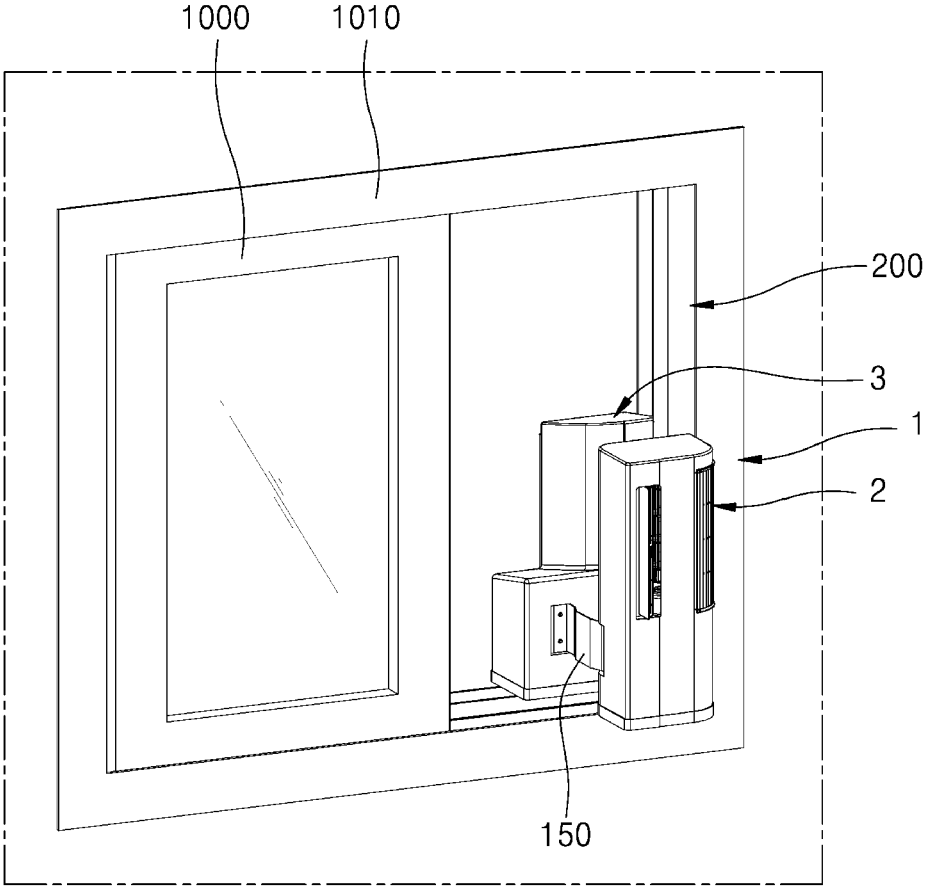

Referring to FIG. 19B, the window type air conditioner 1 may be disposed on the window frame 1010. At this time, the positions of the indoor module 2 and the outdoor module 3 of the window type air conditioner 1 are fixed by the connection support module 100 and the temporary support portion 150. The connection support module 100 of the window type air conditioner 1 may be inserted into the opening 210 (see FIG. 14) of the gap blocking member 200.

Figure 19C:
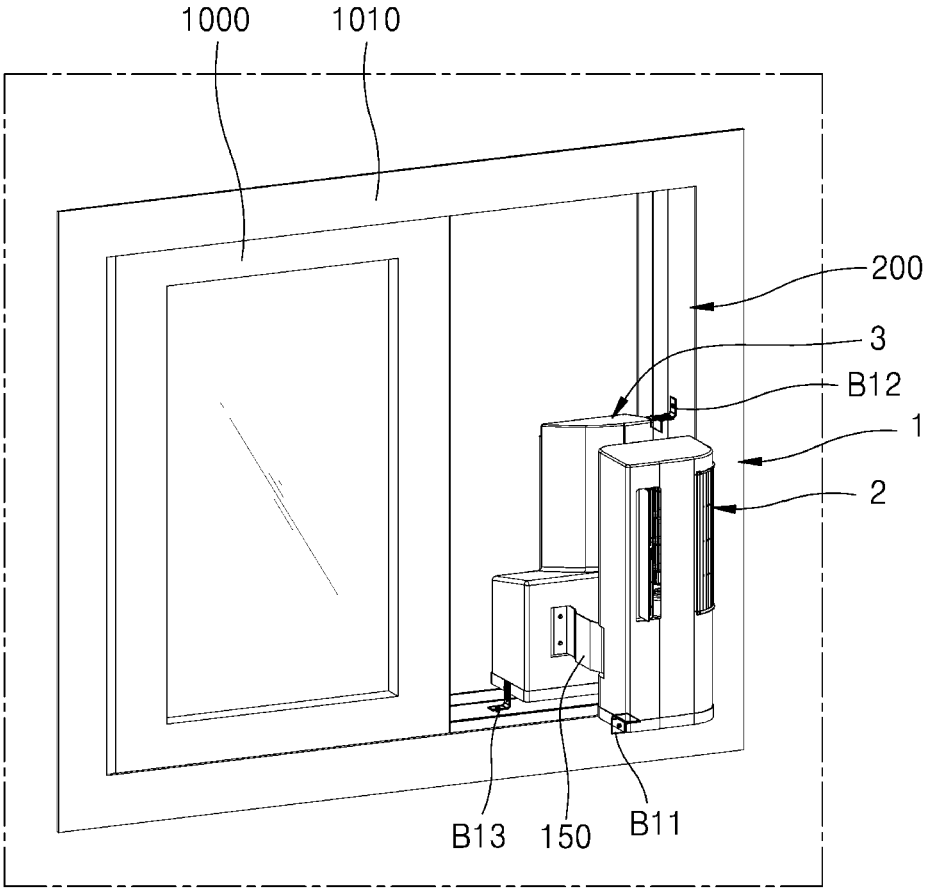

Referring to FIG. 19C, the window type air conditioner 1 may be fixed to the window frame 1010. For example, the indoor module 2 and the outdoor module 3 may be fixed to the window frame 1010 using brackets B11, B12, and B13 so that the window type air conditioner 1 is fixed to the window frame 1010.

Referring to FIG. 20, the indoor module 2 may be fixed using the bracket B11. For example, the bracket B11 may be disposed on the lower portion of the indoor module 2, and fixed to the window frame 1010. The bracket B11 may have an L-shape. A part of the bracket B11 may be fixed to the surface of the window frame 1010 facing the room. The indoor module 2 may be supported by the fixed bracket B11. Through this, the indoor module 2 may be fixed to the window frame 1010.

Referring to FIG. 21, the outdoor module 3 may be fixed using the brackets B12 and B13. For example, the lower and upper portions of the outdoor module 3 may be fixed to the window frame 1010 using a plurality of brackets B12 and B13. For example, the lower portion of the outdoor module 3 and the inner lower surface of the window frame 1010 may be fixed to each other using one bracket B13, and the upper portion of the outdoor module 3 and the inner side surface of the window frame 1010 may be fixed to each other using the other bracket B12. Through this, the outdoor module 3 may be fixed to the window frame 1010.

As described above, the indoor module 2 and the outdoor module 3 may be fixed to the window frame 1010 using the brackets B11, B12, and B13. Accordingly, the positions of the indoor module 2 and the outdoor module 3 may be maintained by the brackets B11, B12, and B13.

Figure 19D:
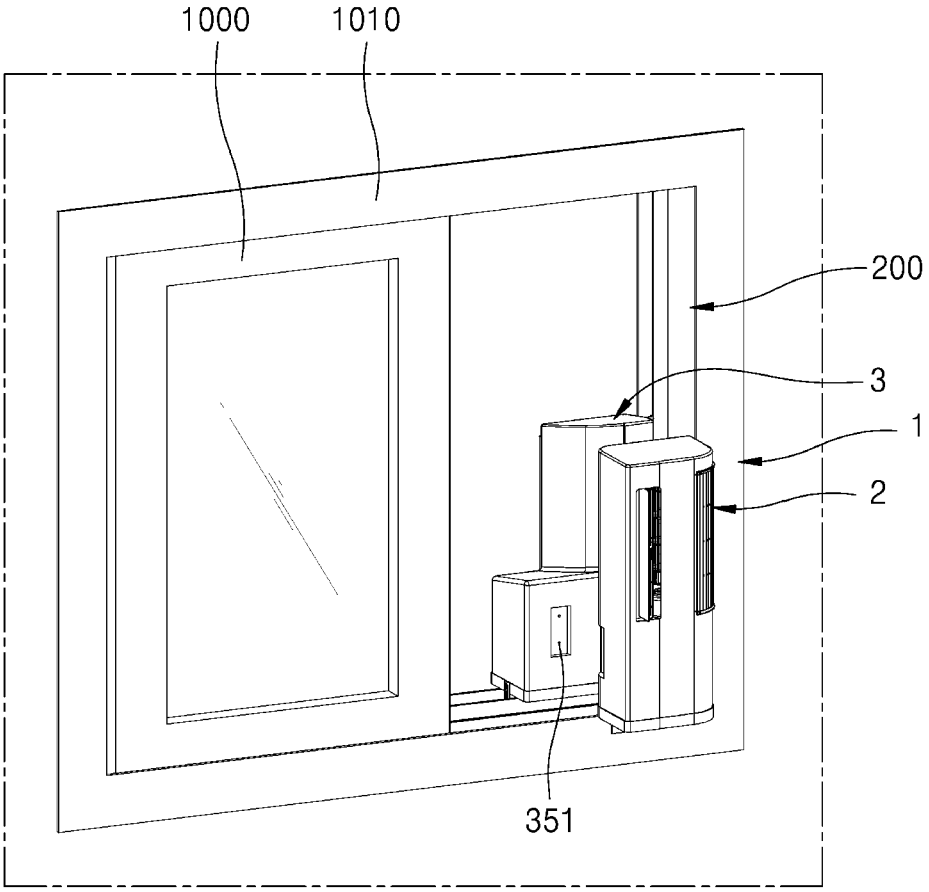

Referring to FIG. 19D, the temporary support portion 150 is separated from the window type air conditioner 1. The temporary support portion 150 may be separated from the indoor module 2 and the outdoor module 3. For example, the temporary support portion 150 may be separated from the indoor module 2 and the outdoor module 3 by loosening the fastening member 160. Because the window type air conditioner 1 is fixed to the window frame 1010 by the brackets B11, B12 and B13, even when the temporary support portion 150 is removed, the relative positions of the indoor module 2 and the outdoor module 3 may be separated.

Figure 19E:
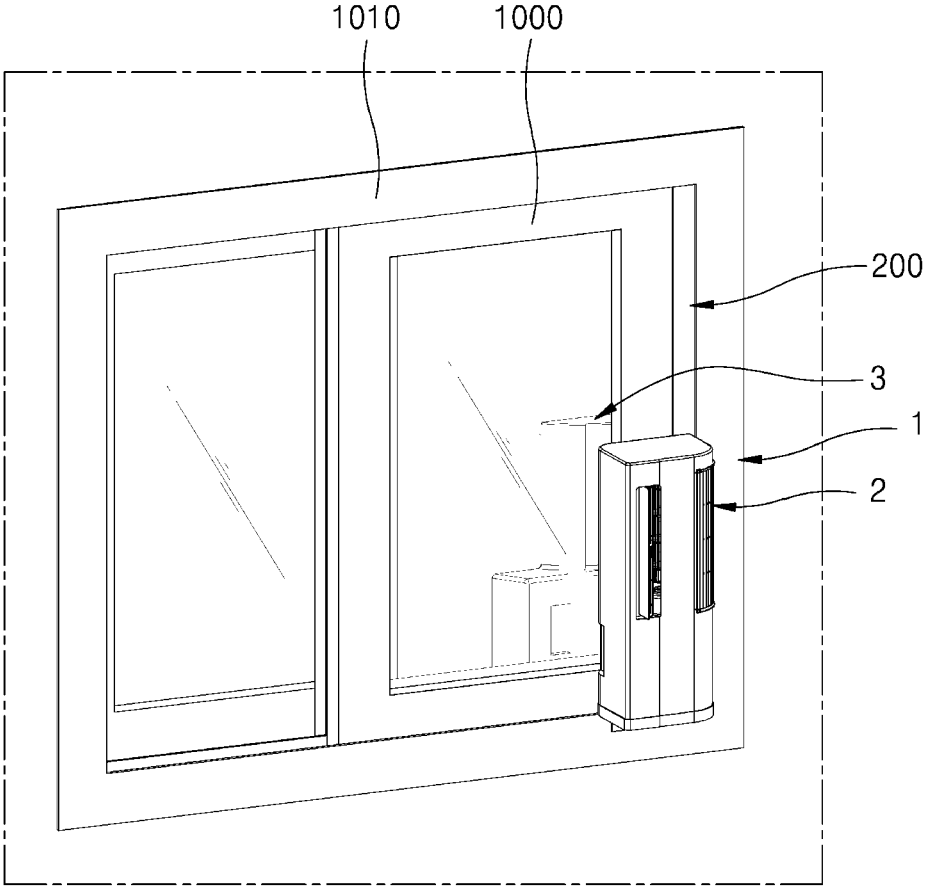

Referring to FIG. 19E, because the temporary support portion 150 is separated, the window 1000 may be moved closer to the connection support module 100. Accordingly, a user or a worker may move the window 1000 to be in close contact with the gap blocking member 200. Accordingly, entrance of noise generated by the outdoor module 3 of the window type air conditioner 1 between the window 1000 and the window frame 1010 may be minimized.

Figure 19F:
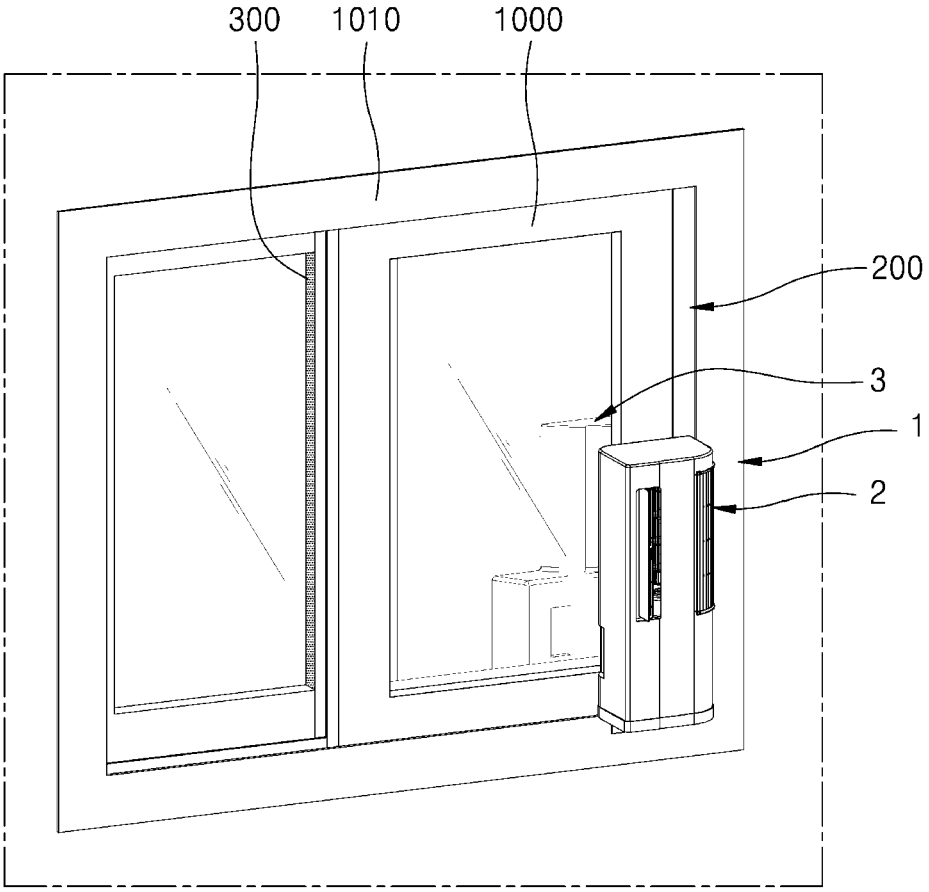

Referring to FIG. 19F, a second gap blocking member 300 may be inserted between the window 1000 and the window 1000. A gap between the window 1000 and the window 1000 is blocked through the second gap blocking member 300. Accordingly, entrance of noise generated by the outdoor module 3 of the window type air conditioner 1 between the window 1000 and the window 1000 may be minimized.

FIGS. 22A to 22G are diagrams illustrating an installation method of the window type air conditioner 1B according to an embodiment of the disclosure.

Figure 22A:
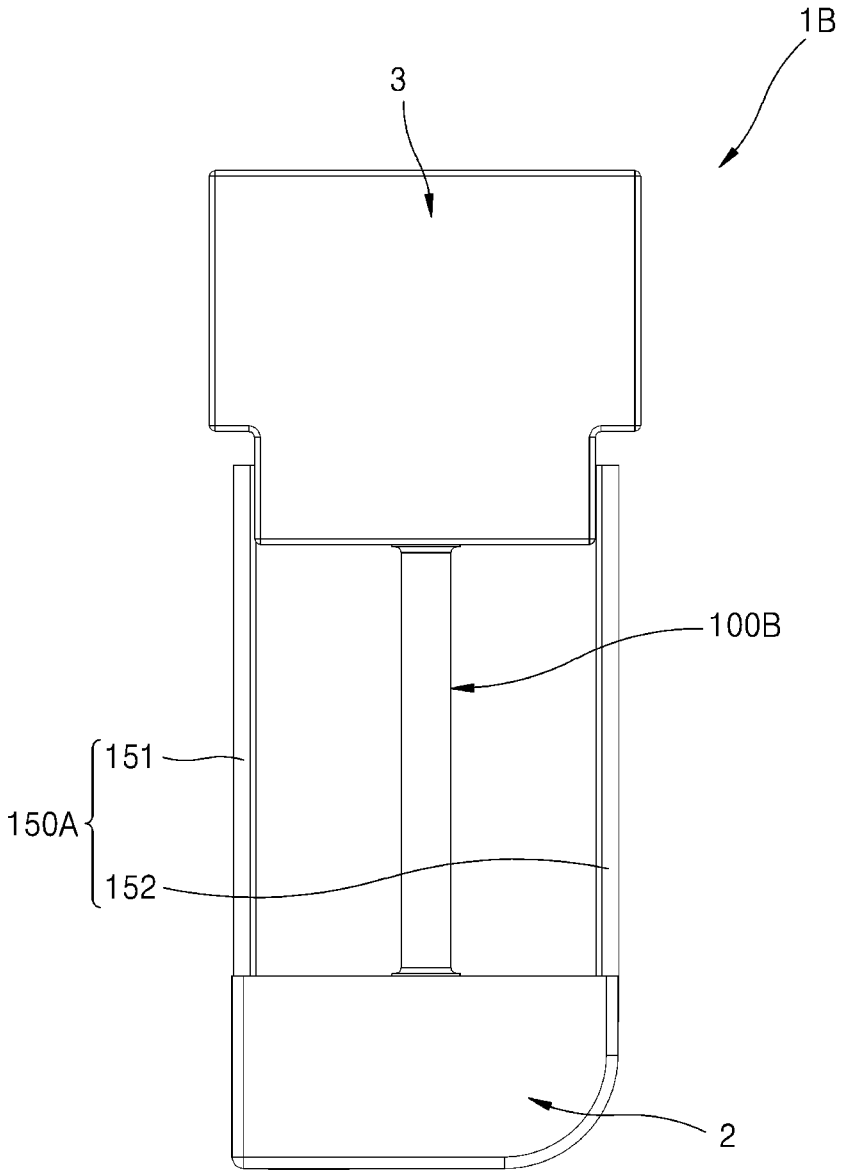
FIGS. 22A to 22G are diagrams illustrating an installation method of a window type air conditioner according to an embodiment of the disclosure.

Referring to FIG. 22A, a worker may check the installation position of the window type air conditioner 1B. For example, the worker may check whether the window type air conditioner 1B is to be installed on the right side of the window frame 1010 or the left side of the window frame 1010.

According to the installation position of the window type air conditioner 1B, the worker may remove one of the pair of temporary plates 151 and 152 of the temporary support portion 150A. For example, when the installation position of the window type air conditioner 1 is on the right side of the window frame 1010, the temporary plate 152 on the right side of the pair of temporary plates 151 and 152 may be separated and removed. At this time, the temporary plate 151 on the left side is fixed to the indoor module 2 and the outdoor module 3.

Figure 22B:
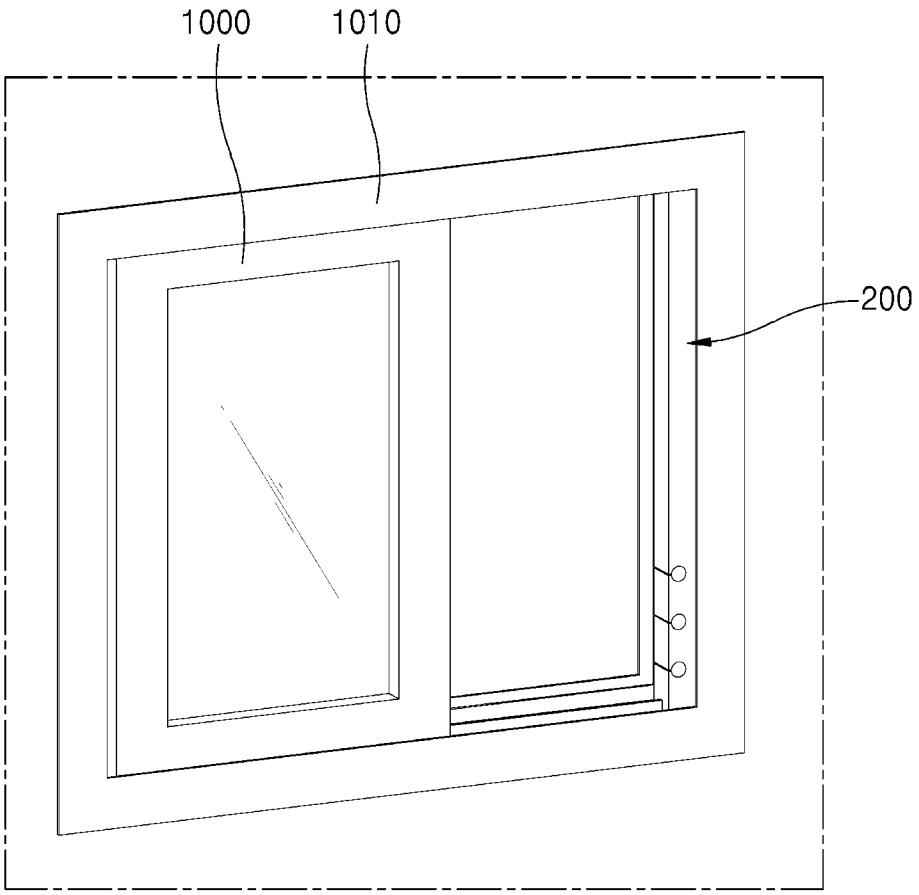

Referring to FIG. 22B, the gap blocking member 200 may be installed on the window frame 1010. The gap blocking member 200 may be fixed to the window frame 1010 by pressing the gap blocking member 200 so that a part of the window frame 1010 is inserted into the window frame coupling groove 215 of the gap blocking member 200. The gap blocking member 200 may be adhered to the window frame 1010 as necessary.

Figure 22C:
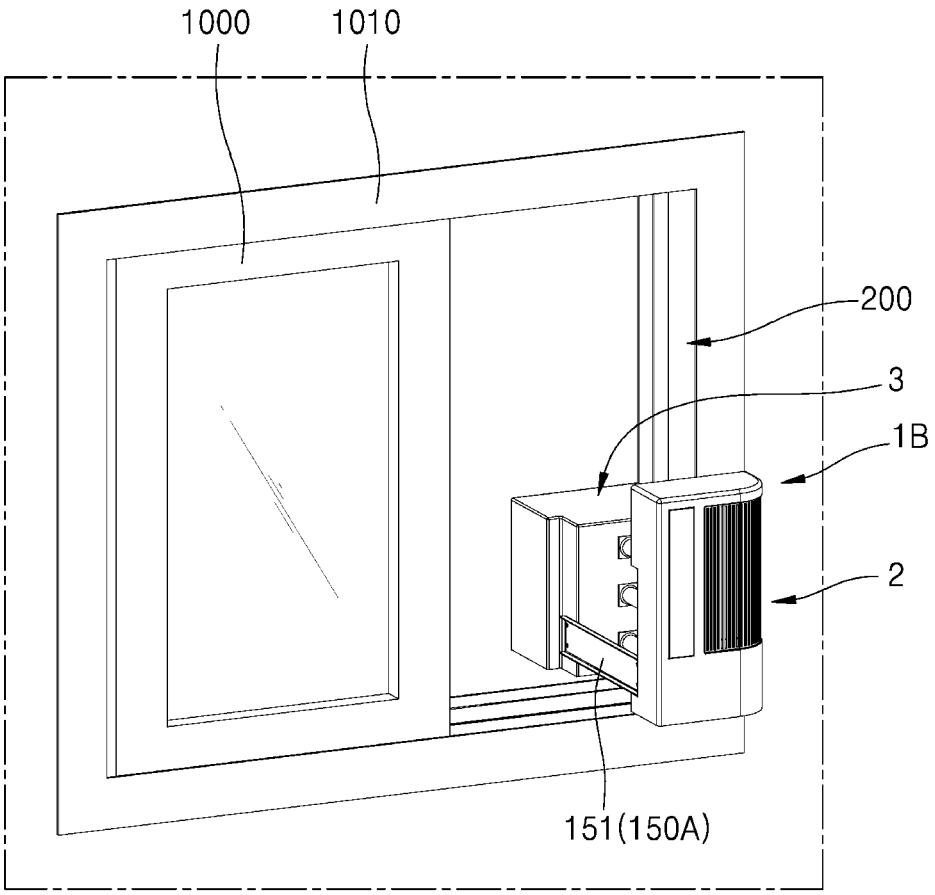

Referring to FIG. 22C, the window type air conditioner 1B may be disposed on the window frame 1010. At this time, the positions of the indoor module 2 and the outdoor module 3 of the window type air conditioner 1B are fixed by the connection support module 100B and the temporary plate 152. The connection support module 100 of the window type air conditioner 1B may be inserted into the opening 210 of the gap blocking member 200.

Figure 22D:
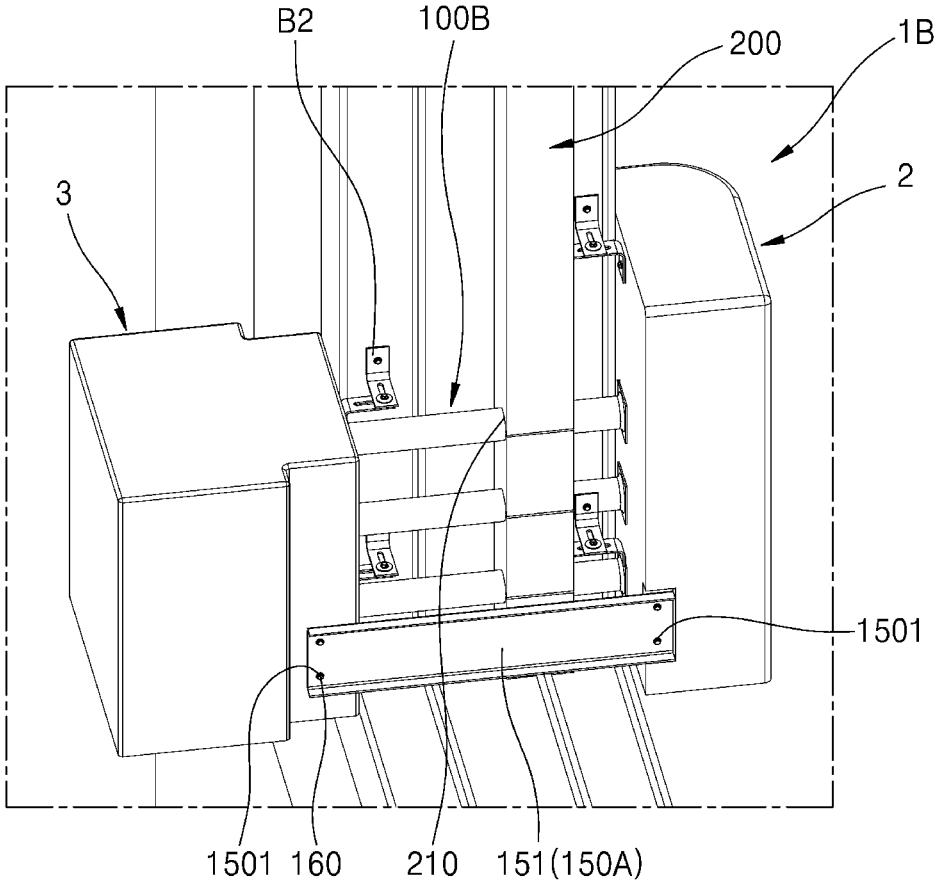

Referring to FIG. 22D, the window type air conditioner 1B may be fixed to the window frame 1010. For example, the indoor module 2 and the outdoor module 3 may be fixed to the window frame 1010 using the bracket B2 so that the window type air conditioner 1 is fixed to the window frame 1010. For example, each of the indoor module 2 and the outdoor module 3 may be fixed to the window frame 1010 using two brackets B2.

As described above, the indoor module 2 and the outdoor module 3 may be fixed to the window frame 1010 using the bracket B2. Accordingly, the positions of the indoor module 2 and the outdoor module 3 may be maintained by the bracket B2.

Figure 22E:
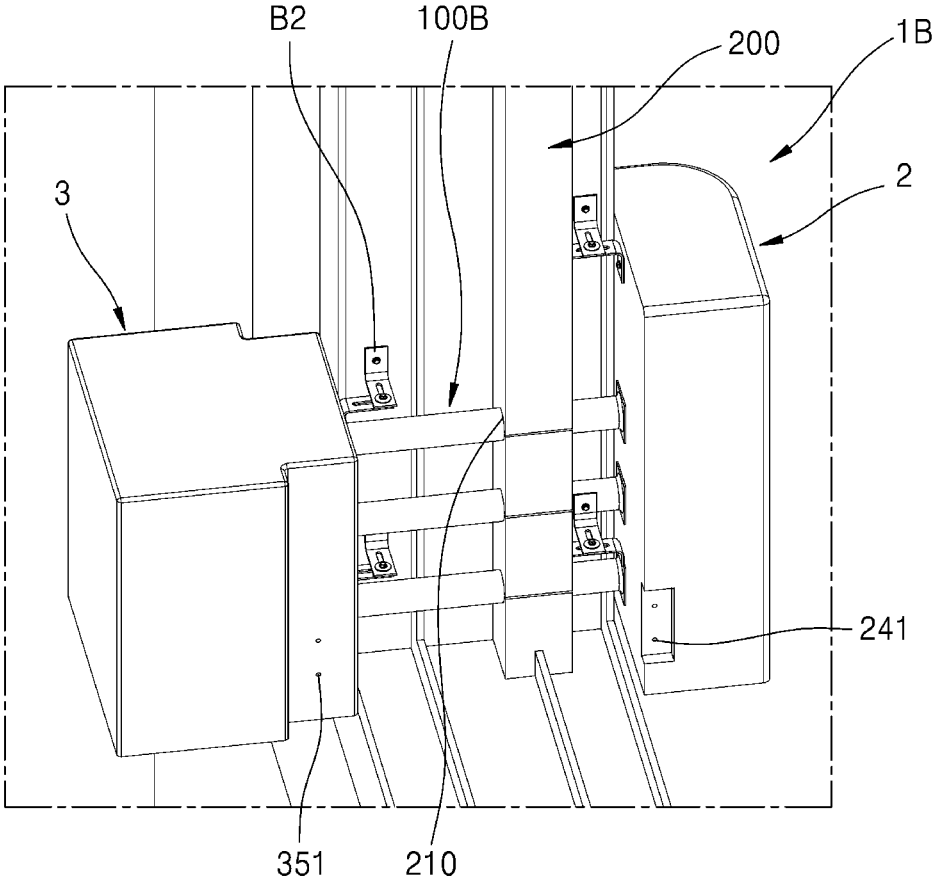

Referring to FIG. 22E, the temporary support portion 150 is removed from the window type air conditioner 1. For example, the other temporary plate 151 of the temporary support portion 150A may be separated from the indoor module 2 and the outdoor module 3 by loosening the fastening member 160. Because the window type air conditioner 1 is fixed to the window frame 1010 by the bracket B2, even when the temporary support portion 150A is removed, the relative positions of the indoor module 2 and the outdoor module 3 may be fixed.

Figure 22F:
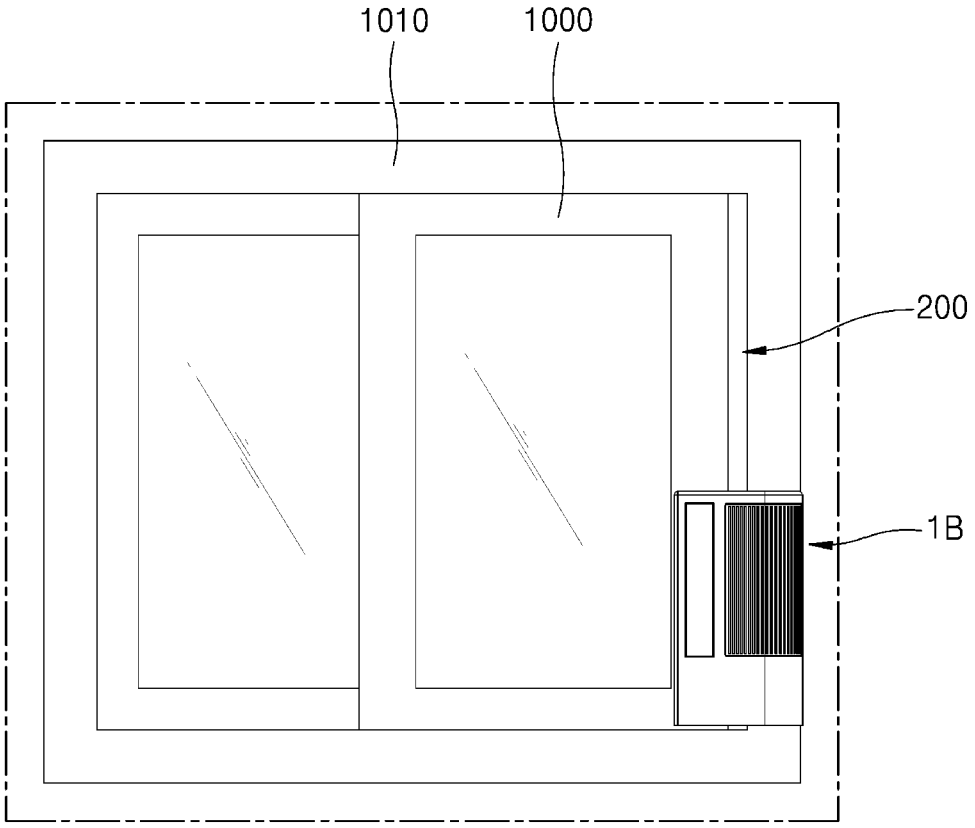

Referring to FIG. 22F, because the temporary support portion 150A is removed, the window 1000 may be moved closer to the connection support module 100B. Accordingly, the user or the worker may move the window 1000 to be into close contact with the gap blocking member 200. Accordingly, entrance of noise generated by the outdoor module 3 of the window type air conditioner 1 between the window 1000 and the window frame 1010 may be minimized.

Figure 22G:
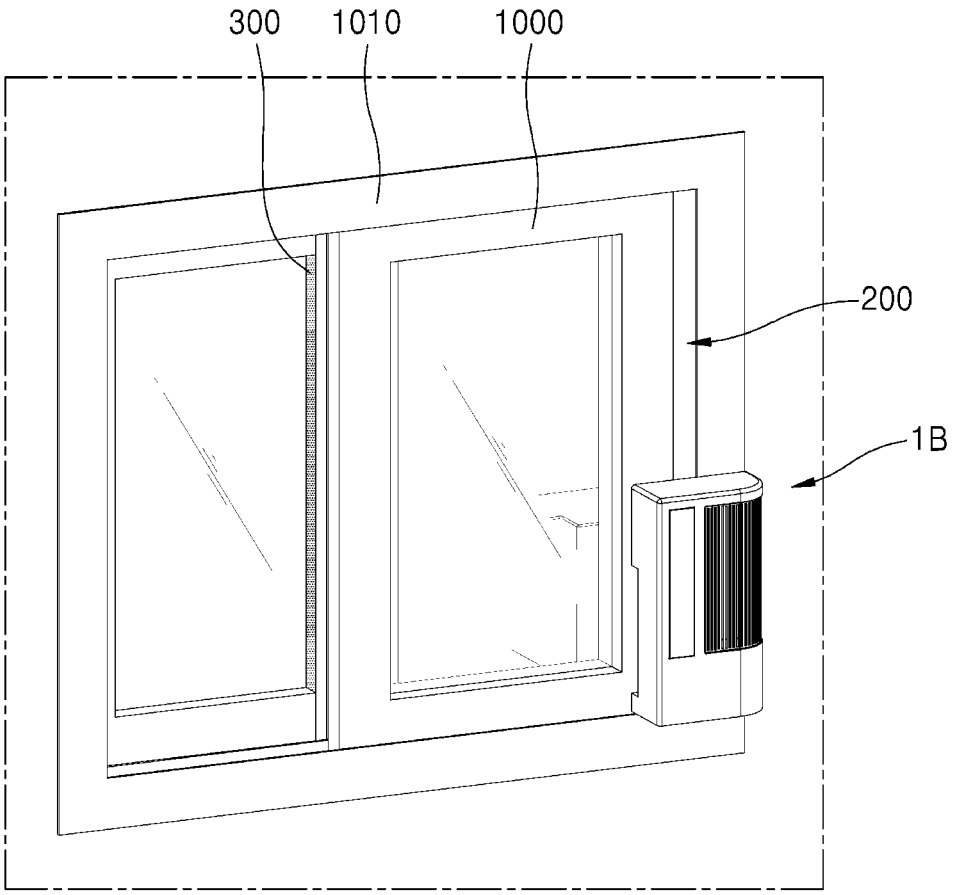

Referring to FIG. 22G, the second gap blocking member 300 may be inserted between the windows 1000. A gap between the window 1000 and the window 1000 is blocked through the second gap blocking member 300. Accordingly, entrance of noise generated by the outdoor module 3 of the window type air conditioner 1 between the window 1000 and the window 1000 may be minimized.

Although reference has been made to embodiments of the disclosure illustrated in the drawings for understanding the disclosure, and specific terms have been used to describe the embodiments thereof, the scope of the disclosure is not limited by the specific terms, and the disclosure will be construed to encompass all embodiments that would normally occur to one of ordinary skill in the art.

Particular implementations described herein merely correspond to embodiments of the disclosure and do not limit the scope of the disclosure in any way. For the sake of brevity of the specification, conventional electronic configurations, control systems, software, and other functional aspects of the systems may be omitted. Furthermore, connecting lines or connectors shown in various figures are intended to represent exemplary functional connections and/or physical or logical couplings between components in the figures, and in an actual device, connections between components may be represented by many alternative or additional functional relationships, physical connections, or logical connections. In addition, an element may not be necessarily essential to the practice of the disclosure unless the element is specifically described as essential," "critical," etc. As used herein, the term such as "comprising", "including" and the like are used to be understood as being an open-ended term for describing embodiments of the disclosure.

The use of the terms "the" and similar referents in the context of describing the disclosure (especially in the context of the following claims) are to be construed to cover both the singular and the plural. Furthermore, recitation of ranges of values herein are merely intended to serve as a shorthand method of referring individually to each separate value falling within the range (unless otherwise indicated herein), and each separate value is incorporated into the specification as when it were individually recited herein. Lastly, operations of methods according to the disclosure described herein may be performed in any suitable order unless clearly specified herein or contradicted by context. The disclosure is not limited to the described order of the operations. The use of any and all examples or exemplary language, e.g., "such as", etc., provided herein is merely intended to describe the disclosure in detail and does not pose a limitation on the scope of the disclosure unless otherwise limited by the claims. Furthermore, various changes and modifications will be readily apparent to one of ordinary skill in the art without departing from the spirit and scope of the disclosure.

The invention claimed is:

1. A window type air conditioner installable on a window frame, the window type air conditioner comprising:
- an outdoor module including:
  - a compressor configured to compress a refrigerant,
  - an outdoor heat exchanger configured to perform heat exchange between outdoor air and the refrigerant, and
  - an outdoor housing configured to accommodate the compressor and the outdoor heat exchanger;
- an indoor module including:
  - an indoor heat exchanger configured to perform heat exchange between indoor air and the refrigerant, and
  - an indoor housing spaced apart from the outdoor housing and configured to accommodate the indoor heat exchanger;
- a refrigerant pipe through which the refrigerant moves between the indoor module and the outdoor module, the refrigerant pipe including:
  - a first refrigerant pipe configured to connect between the compressor and the indoor heat exchanger, and
  - a second refrigerant pipe configured to connect between the outdoor heat exchanger and the indoor heat exchanger; and
- a connection support module including:
  - a first connection rod having an inner circumferential surface, the first connection rod including:
    - a first refrigerant connection frame configured to surround the first refrigerant pipe, and
    - a second refrigerant connection frame configured to surround the second refrigerant pipe, and
  - a sealing member arranged inside the first connection rod,
- wherein the connection support module is configured so that
  - the connection support module connects the indoor module and the outdoor module, and supports a positional relationship between the indoor module and the outdoor module,
  - the refrigerant pipe extends through the first connection rod so that an inner circumferential surface of the first connection rod is spaced apart from an outer circumferential surface of the refrigerant pipe,
  - the sealing member is arranged between the outer circumferential surface of the refrigerant pipe and the inner circumferential surface of the first connection rod to form a seal between the refrigerant pipe and the first connection rod, and
  - the first refrigerant connection frame and the second refrigerant connection frame are arranged along a vertical direction.

2. The window type air conditioner of claim 1, wherein a width of the first connection rod is up to 5 times greater than a diameter of the refrigerant pipe.

3. The window type air conditioner of claim 1, wherein a height of the first connection rod is up to 5 times greater than a width of the first connection rod.

4. The window type air conditioner of claim 1, wherein the first refrigerant connection frame and the second refrigerant connection frame are spaced apart from each other in the vertical direction.

5. The window type air conditioner of claim 4, wherein the connection support module includes a reinforcing plate arranged between the first refrigerant connection frame and the second refrigerant connection frame.

6. The window type air conditioner of claim 1, wherein the first refrigerant connection frame and the second refrigerant connection frame are configured to contact each other in the vertical direction.

7. The window type air conditioner of claim 1, further comprising:

a wire configured to form electrical connection between the indoor module and the outdoor module, wherein the connection support module further includes a second connection rod configured to accommodate the wire therein and having a structure surrounding the wire.

8. The window type air conditioner of claim 1, further comprising:

a temporary support portion detachably connected between the indoor module and the outdoor module, the temporary support portion configured to:

support the positional relationship between the indoor module and the outdoor module, and be removed before the window type air conditioner is installed on the window frame.

9. The window type air conditioner of claim 8, wherein the indoor housing and the outdoor housing respectively include first fastening holes configured to receive a fastening member, the temporary support portion includes a plurality of second fastening holes corresponding to the first fastening holes of each of the indoor housing and the outdoor housing, when the fastening member is received into the first fastening holes and the plurality of the second fastening holes, the temporary support portion is fixed to the indoor housing and the outdoor housing, and when the fastening member is separated from the first fastening holes and the plurality of the second fastening holes, the temporary support portion is detached from the indoor housing and the outdoor housing.

10. The window type air conditioner of claim 8, wherein the temporary support portion includes a pair of support plates detachably connected to the indoor module and the outdoor module respectively on opposite sides.

11. The window type air conditioner of claim 1, further comprising:

a gap blocking member including openings configured to accommodate the connection support module, and configured to form a seal between a window and the window frame.

12. The window type air conditioner of claim 1, further comprising:

a drain hose configured to transfer condensed water generated by the indoor heat exchanger to the outdoor module, wherein a height of at least a part of the drain hose is lowered from the indoor module to the outdoor module so that the condensed water moves toward the outdoor module due to gravity.

* * * * *